US007040810B2

(12) United States Patent
Steele

(10) Patent No.: US 7,040,810 B2
(45) Date of Patent: May 9, 2006

(54) FLEXIBLE PACKAGE WITH A TRANSVERSE ACCESS PANEL DEVICE

(76) Inventor: Mark Steele, 31515 Cambria Ave. North, LeSueur, MN (US) 56058

( * ) Notice: Subject to any disclaimer, the term of this patent is extended or adjusted under 35 U.S.C. 154(b) by 252 days.

(21) Appl. No.: 10/396,295

(22) Filed: Mar. 25, 2003

(65) Prior Publication Data

US 2003/0210838 A1 Nov. 13, 2003

Related U.S. Application Data

(60) Provisional application No. 60/372,709, filed on Apr. 11, 2002, provisional application No. 60/368,121, filed on Mar. 26, 2002.

(51) Int. Cl.
*B65D 33/16* (2006.01)

(52) U.S. Cl. ..... 383/66; 383/10; 383/63; 383/210; 383/906

(58) Field of Classification Search ..... 383/66, 383/906, 210–211, 63, 61.2, 10
See application file for complete search history.

(56) References Cited

U.S. PATENT DOCUMENTS 1,980,104 A * 11/1934 Silverspitz ..... 43/26
3,367,380 A * 2/1968 Dickey ..... 383/104
4,332,344 A 6/1982 Strodthoff
4,909,017 A 3/1990 McMahon
4,913,561 A 4/1990 Beer
5,050,736 A 9/1991 Griesbach et al.
5,059,036 A 10/1991 Richison et al.
5,060,803 A 10/1991 Beer et al.
5,147,272 A 9/1992 Richison et al.
5,254,073 A 10/1993 Richison et al.
5,461,845 A 10/1995 Yeager
5,547,284 A 8/1996 Imer
5,672,009 A 9/1997 Malin
5,692,837 A 12/1997 Beer
5,716,473 A 2/1998 Gordon et al.
5,782,733 A 7/1998 Yeager
5,788,378 A 8/1998 Thomas
5,806,984 A 9/1998 Yeager
5,828,933 A 10/1998 Rees et al.
5,829,884 A 11/1998 Yeager
5,882,117 A 3/1999 Laffon
5,902,047 A 5/1999 Yeager
5,951,453 A 9/1999 Yeager
5,954,433 A 9/1999 Yeager
5,972,396 A 10/1999 Jurgovan et al.
6,019,512 A 2/2000 Yeager
6,021,624 A 2/2000 Richison et al.

(Continued)

*Primary Examiner*—Jes F. Pascua
(74) *Attorney, Agent, or Firm*—Patterson, Thuente, Skaar & Christensen, P.A.

(57) ABSTRACT

A flexible package generally including a front panel portion, a back panel portion, a first side panel portion, and at least one access device. The flexible package can further include a second side panel portion, a bottom panel portion, and a top panel portion. Additionally, one or more of the portions can be shaped and/or manufactured substantially as a gusset. Each of the panel portions comprise two longitudinal sides or edges. The access-device can be attached to at least one surface of at least one of the side panel portions such that the device is in transverse orientation to the longitudinal sides. The device can be manually attached to the side portions, or attached with existing and/or specially designed manufacturing machinery. Attachment of the access device to a side portion of the package is achieved using heat bonding techniques, adhesives, and the like.

17 Claims, 18 Drawing Sheets

U.S. PATENT DOCUMENTS 6,040,033 A 3/2000 Johnson
6,044,621 A 4/2000 Malin et al.
6,065,873 A 5/2000 Fowler
6,079,878 A 6/2000 Yeager
6,106,153 A * 8/2000 Toshima ..... 383/204
6,115,892 A 9/2000 Malin et al.
6,164,826 A 12/2000 Petkovsek
6,176,615 B1 1/2001 Leimkuehler
6,177,172 B1 1/2001 Yeager
6,186,663 B1 2/2001 Ausnit
6,224,262 B1 5/2001 Hogan et al.
6,327,837 B1 12/2001 Van Erden
6,350,058 B1 2/2002 Linton
6,516,850 B1 2/2003 Blohowiak et al.
6,572,267 B1 6/2003 Forman
6,820,391 B1 * 11/2004 Barmore et al. ..... 53/133.4

* cited by examiner

FLEXIBLE PACKAGE WITH A TRANSVERSE ACCESS PANEL DEVICE

RELATED APPLICATIONS

The applicant hereby claims benefit of the contents and filing date accorded to U.S. Provisional Patent Application filed Mar. 26, 2002, entitled "Flexible Package With A Transverse Re-Closeable Device" and assigned Ser. No. 60/368,121, and U.S. Provisional Patent Application filed Apr. 11, 2002, entitled "Flexible Package With A Transverse Re-Closeable Device" and assigned Ser. No. 60/372,709, with both of said applications being incorporated herein by reference.

FIELD OF THE INVENTION

The present invention relates generally to flexible packaging and, more particularly, to flexible packages, and methods for manufacturing and using packages, having a side panel access device integrated in, and in a transverse relationship to the longitudinal axis of, a side panel of the package.

BACKGROUND OF THE INVENTION

Gusset-type packages made of sheet materials are commonly utilized in many fields to hold food, chemicals, liquids, and a myriad of other materials. Further, the gussets are utilized on side and/or end portions of the packages to provide spatial surface flexibility of the packages, thus facilitating expansion and contraction of the internal volume of the package. When the packages are empty they take up minimum volume, and as they are filled the internal volume expands to a maximum volume level, depending on the size of the packages and the corresponding gusset(s). Consequently, gusseted packages are capable of maximizing material storage and handling in a full state, while still having beneficial contraction properties that facilitate storage, handling, shipping, and disposal in a substantially empty state.

Conventional gusseted packages utilize gusset portions at the side and/or bottom end portions of the package such that openings, such as a re-closeable device, can be integrated into the top end portion of the package. This configuration allows for the benefits of the gusset features and provides an access opening for filling and emptying the material contents. U.S. Pat. Nos. 4,913,561, 5,692,837, and 6,186,663 disclose such packaging. The innate drawback of this type of packaging lies in the measurable reduction in material holding resulting from the location and design of the re-closeable access opening. The zipper-type openings merely serve to close off the top portion of the package by pulling together the top portions of the front and back panels. This closure technique significantly reduces the internal holding volume of the package since, in a closed position, the side gussets are forced to contact at the end proximate the access opening.

U.S. Pat. No. 5,788,378 discloses an attempt to accommodate for this internal volume reduction by adding a relatively rigid triangular fin assembly that extends upward away from the package panels and integrated gussets. This fin assembly includes a re-closeable zipper-type opening. Such a configuration permits full use of the internal volume provided by the gusseted portions of the package. However, this type of gusseted package merely introduces different problems. First, the fin assembly introduces complexity into the manufacturing and use of the product. Second, the fin assembly adds sizeable mass to the package that is detrimental to storage, handling, shipping, and disposal.

U.S. Pat. Nos. 5,461,845, 5,782,733, and 5,954,433 disclose attempts to reduce the discussed internal volume reduction that occurs when a re-closeable opening is achieved by joining at least two flexible package panels. These patents are directed to re-closeable access openings that permit access in and out of the internal cavity of the package through the front or back non-gusseted panels. As a result, the internal volume capacity of the package is not substantially reduced by joining two panels, thus avoiding many of the problems associated with the resulting measurable collapse of the side gussets. However, these patents are limited to using these single panel access devices on front or back panel portions. When access devices are limited to front and back panel portions of the packages, manufacturing flexibility and convenience-of-use are greatly sacrificed. The location for handles, the size of the re-closeable device, and a myriad of other packaging features, designs, and methods are negatively effected by the limited integration options of the re-closeable devices.

Further, pouring efficiency and convenience is sacrificed. Typically, the front and back panels are understood to be larger than the side panels, with most re-closeable devices being some size measurably smaller than the width of these front and back panels. As a result, there are generally significant spaces between the edges of these front and back panels and the ends of the re-closeable device. This wasted space is the primary cause of the pouring inefficiency. It is difficult to guide the content material efficiently through the re-closeable device. Inevitably, the contents will channel to the internal package area above, below, and to the sides of the re-closeable device such that forceful shaking and tilting are required to get the flow of material correctly directed through the re-closeable device.

As a result, there is a need for a flexible package that substantially solves the above-referenced problems present with conventional package designs, configurations, and manufacturing methods.

SUMMARY OF THE INVENTION

The present invention solves many of the problems that plague conventional flexible packages and packaging methods. Various embodiments of the present invention are directed to a flexible package can include a front panel portion, a back panel portion, a first side panel portion, and at least access device. The flexible package can further include a second side panel, a bottom panel portion, and a top panel portion. Additionally, one or more of the portions can be shaped and/or manufactured substantially as a gusset. Each of the panel portions comprise two longitudinal sides or edges. These panels incorporating gusseted features further include a longitudinal gusset line for selective measurable expansion and retraction of the longitudinal sides in relation to each other. This selective expansion/retraction permits adjustment of the gusset surface area and, consequently, a corresponding change to the internal volume of the inner cavity of the flexible package.

The access device can be integrated along the surface of at least one of the side panel portions such that the device is in transverse orientation to the longitudinal sides. Preferably, the access device is a re-closeable access device, but it can include a single use access device. In an upright package, side panels are generally defined as those panels with a distance measurement of "B" between the longitudinal sides being some distance shorter than a distance "A" between the longitudinal sides on adjacently attached/integrated front and/or back panels. It should be noted that any of the panels can be marked with graphical indicia, but such indicia is not necessary. Indicia can further be utilized in performing registration alignment of the various package panels during manufacturing and/or forming.

The re-closeable device can be manually attached to or through the side portions, or attached with existing and/or specially designed manufacturing machinery. Attachment or integration of the re-closeable access device to at least one side portion of the package can be achieved using heat seal/bonding techniques, adhesives, and other known techniques. Additionally, the present invention can be directed to the integration of a re-closeable device transverse to the manufacturing/machining direction or longitudinal side edges of a side panel, gusseted or non-gusseted.

Various embodiments of the present invention substantially eliminate conventional flexible package limitations regarding attachment options and internal volume utilization. The present invention enables manufacturing of a package wherein a re-closeable access opening is integrated into the package without significantly reducing the available material holding capacity of the package. The present invention does not require the opening and closing of the end portions of package panels that will limit volumetric capacity. Instead, a re-closeable access opening can be integrated into at least one of the side panels, gusseted or non-gusseted. The access opening is attached/integrated to the panel, therefore transforming said panel into an access panel, wherein the opening can be some size measurably smaller in length than the distance "A" between the longitudinal edges of the access panel, and in perpendicular/transverse orientation to the edges. The sizing option for the access opening reduces material and manufacturing costs. Re-closeable access devices in accordance with the present invention permit access in and out of the internal cavity of the package through the access panel, thus avoiding the inherent problems associated with those conventional packages requiring the joining or interlocking of two or more panel portions, i.e., the front and back panels.

Further, the re-closeable access device can serve as an efficient and preferred pour spout for conveniently unloading material from the package without altering the volumetric capacity of the package. The access device can be positioned at a predetermined location on the access panel portion according to the particular needs of the manufacturer and/or end user. This positioning flexibility in turn increases the configuration and design options for the package. For instance, handles and like features can be attached or integrated to the package without interfering with the function and use of the re-closeable access device. Additionally, a selectively locatable re-closeable device on one or both of the side panel portions substantially increases the pouring or unloading efficiency of the material out of the package. With such a side-integrated access device, the material is channeled out the side access panel rather than the traditionally larger front or back panel portions. This provides for much better control over the direction and speed of the exiting material, as well as significant control over the quantity of material being poured. Further, since the re-closeable device is generally a substantial expense in the manufacturing of flexible packaging, the integration of a measurably smaller device to the typically smaller side panel(s) increases convenience, efficiency, and saves costs.

DETAILED DESCRIPTION OF PREFERRED EMBODIMENTS

Figure 2:
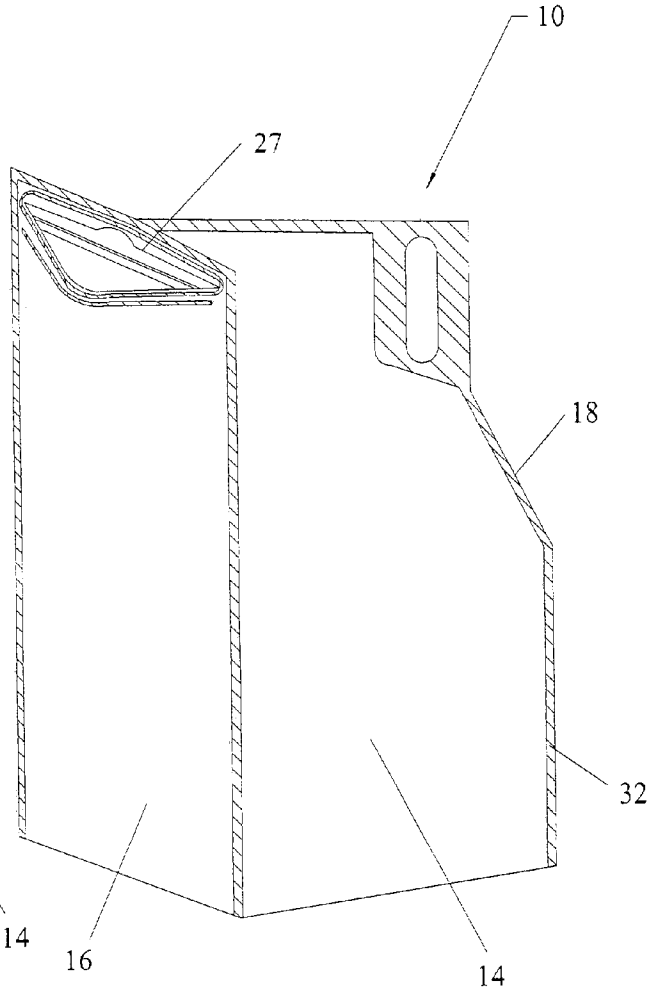
FIG. 2 is a perspective view of an embodiment of a flexible package having an opened integrated transverse re-closeable device in accordance with the present invention.
Figure 1:
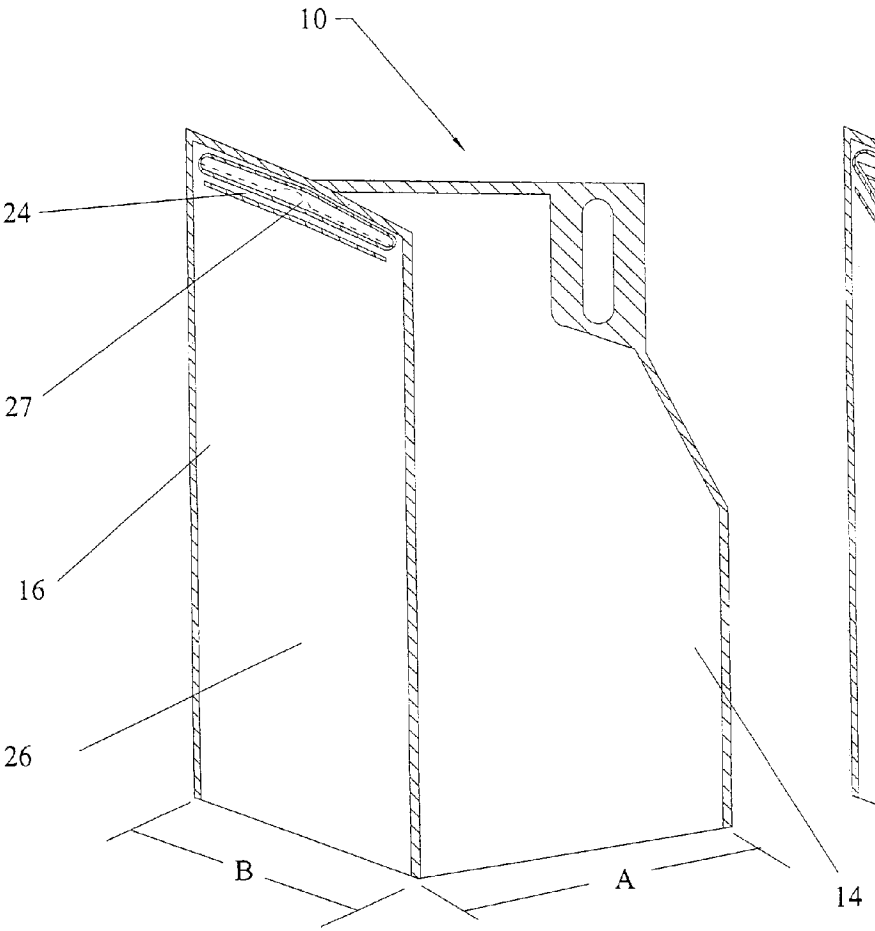
FIG. 1 is a perspective view of an embodiment of a flexible package having an integrated transverse re-closeable device and peel seal in accordance with the present invention.

Referring to FIGS. 1–24, a flexible package 10 and components and configurations in accordance with embodiments of the present invention are shown. The package 10 generally includes a front panel portion 12, a back panel portion 14, a first side panel portion 16, and an access device 24. In addition, the package 10 can include a second side panel portion 18, a top panel portion 20, and a bottom panel portion 22. The joining and/or shaping of the above-referenced panels (as will be discussed in greater detail herein) define the package 10 with an internal cavity 25, having an adjustable internal volume capacity. The panels 12–22 are often referred to as "webs." Each panel can be formed from an individual web or, alternatively, each of the panels can be portions of a larger single web, wherein the large web is folded, cut and/or shaped to define the individual panel portions and, ultimately, the shape and size of the package 10. Further, in one embodiment, the top 20 and bottom 22 panel portions can be formed by the selective joining of the respective end portions of the panels 12, 14 some size measurably longer than the panels 16, 18 to provide necessary material for folding to form said panels 20, 22. Regardless of the formation techniques or the use of separate web panels, a designate panel portion is defined for each panel.

In an upright flexible package 10, the side panels 16, 18 are generally defined as those panels with a distance measurement of "B" between the longitudinal sides being some distance shorter than a distance "A" between the longitudinal sides on adjacent front 12 and/or back panels 14. As such, these side panels 16, 18 are comparably smaller in width than the panels 12, 14 to provide for the narrower and more efficient channel for routing exiting material held within the inner cavity 25, as described herein.

Referring primarily to FIGS. 1–12, the package panel portions 12–22 are generally constructed of flexible sheet material such as polyethylene, polyester, metal foil, polypropylene, or polyethylenes laminated with other materials such as nylon, polyester, and like films. To provide for increased barrier properties, embodiments can use composite layers of said materials and material of the like. Generally, in such composite embodiments, a material having preferred sealing characteristics can be joined, bonded or laminated to a material having a different preferred characteristic (i.e., beneficial oxygen barrier properties). Regardless, single sheets, composites/laminates, and a myriad of other materials and techniques know to one skilled in the art may be implemented based on particular usage and manufacturing needs without deviating from the spirit and scope of the present invention.

The first side panel 16, second side panel 18, top panel 20, and bottom portion 22 can all be gusseted. Similarly, the package 10 can be formed of non-gusseted, or selectively gusseted panels. A gusseted portion is generally denoted by a subscript "g". For instance a gusseted first side portion will be indicated at $\mathbf{16}_g$, a gusseted second side portion will be indicated at $\mathbf{18}_g$, and so on, to define gusseted panels $N_g$, where N is the reference number assigned to a particular panel portion of the package 10. Each gusseted panel portion generally includes centerline 26 (FIG. 1), wherein the centerline 26 is generally a longitudinal reference line, not necessarily denoting an actual folding line on the panels (i.e., imaginary).

Figure 8:
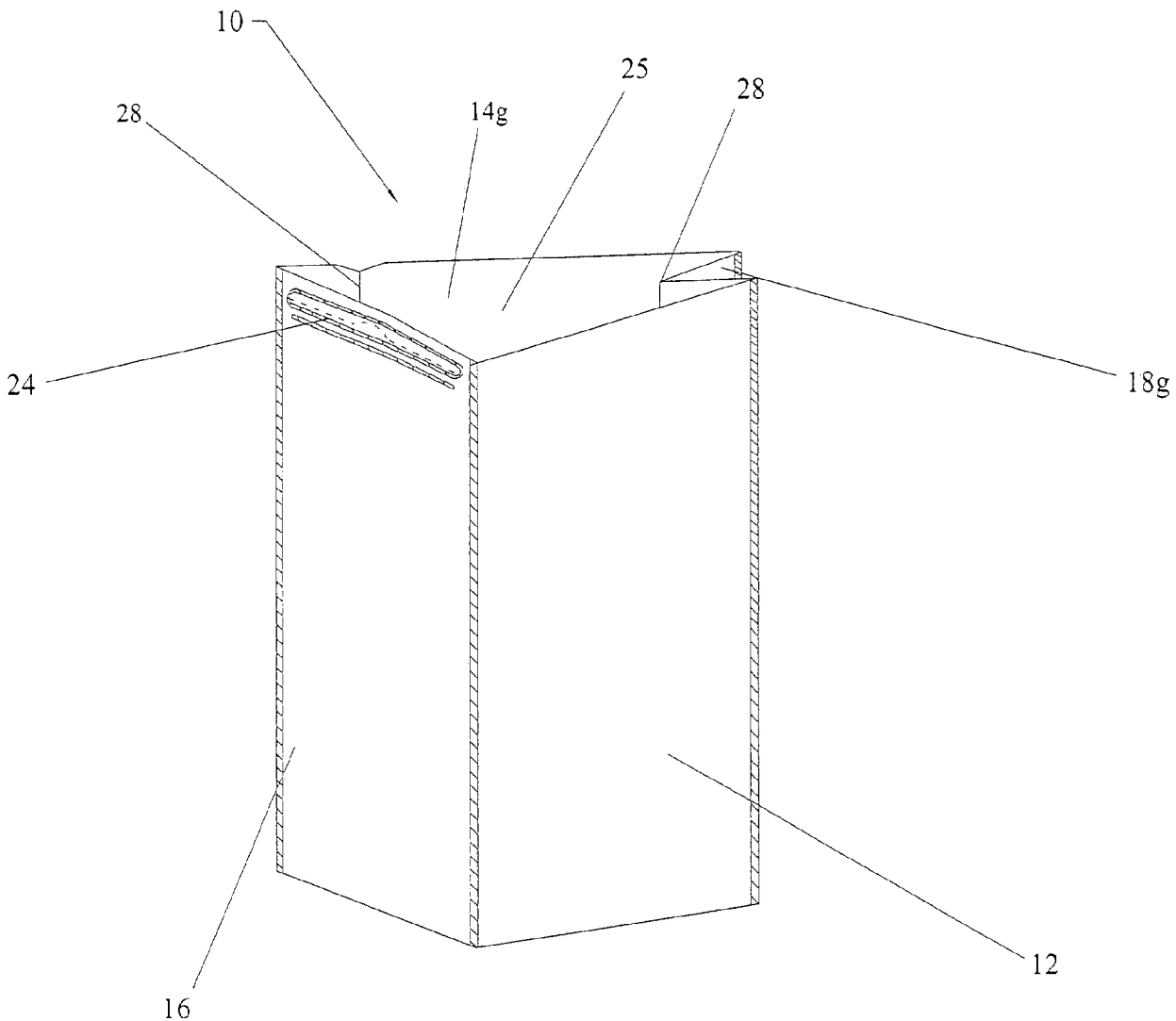
FIG. 8 is a perspective view of a flexible package having an unsealed top opening in accordance with an embodiment of the present invention.
Figure 9:
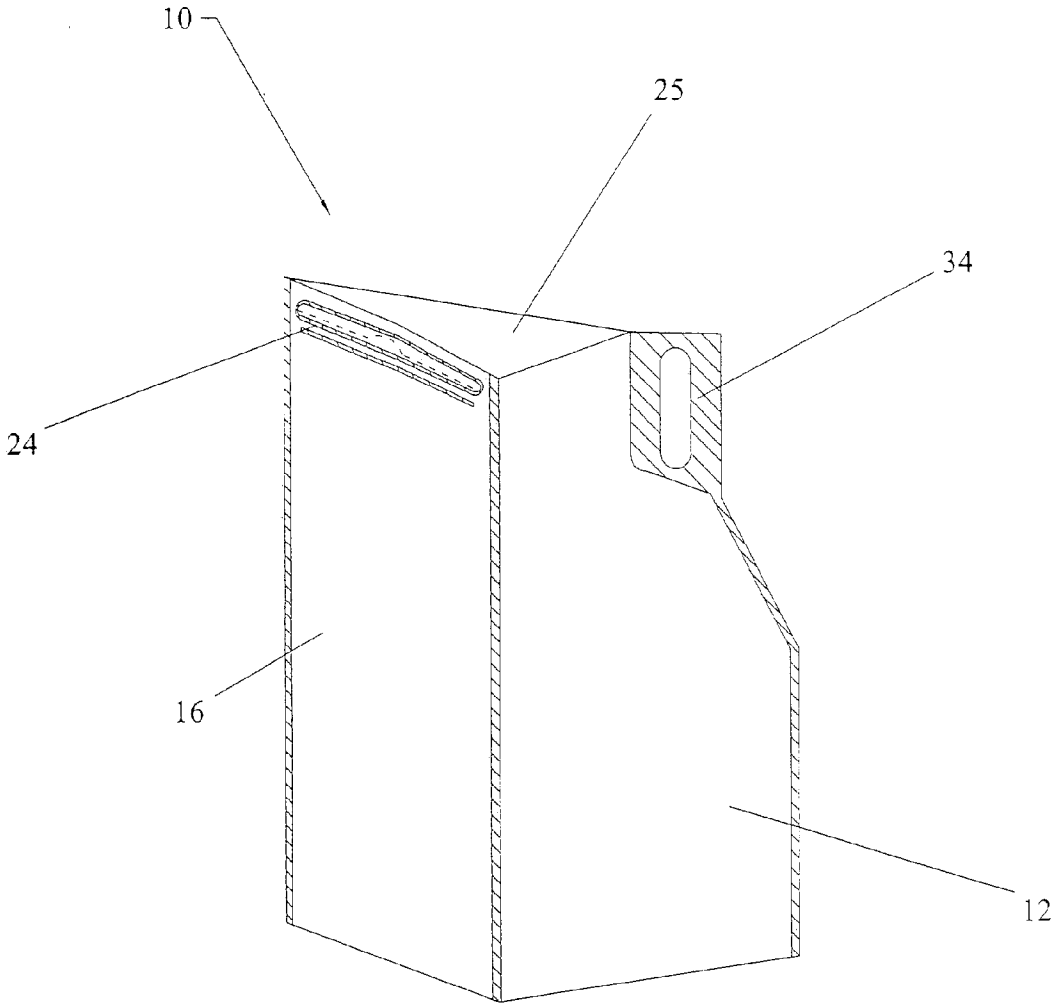
FIG. 9 is a perspective view of a flexible package having an unsealed top opening in accordance with an embodiment of the present invention.
Figure 10:
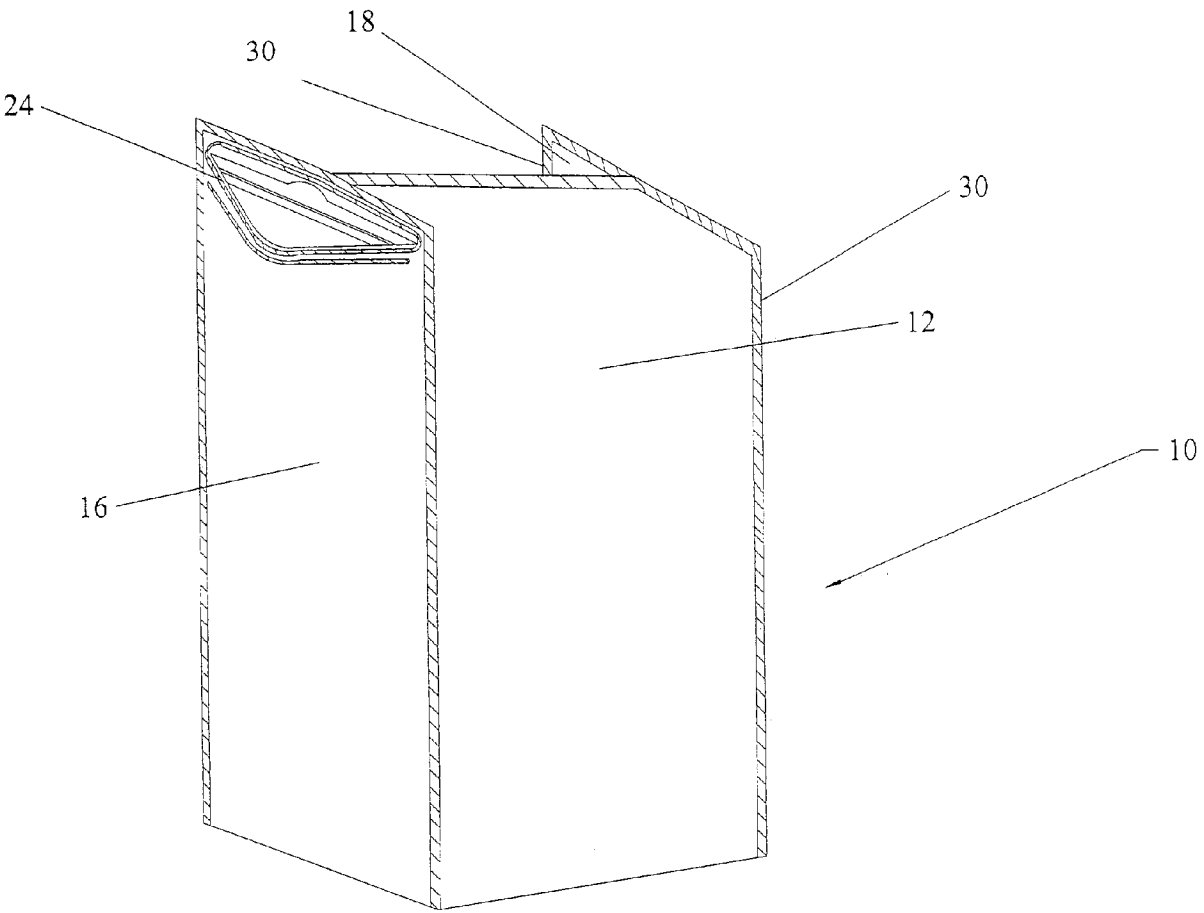
FIG. 10 is a perspective view of an embodiment of a flexible package having an open integrated transverse re-closeable device in accordance with the present invention.
Figure 11:
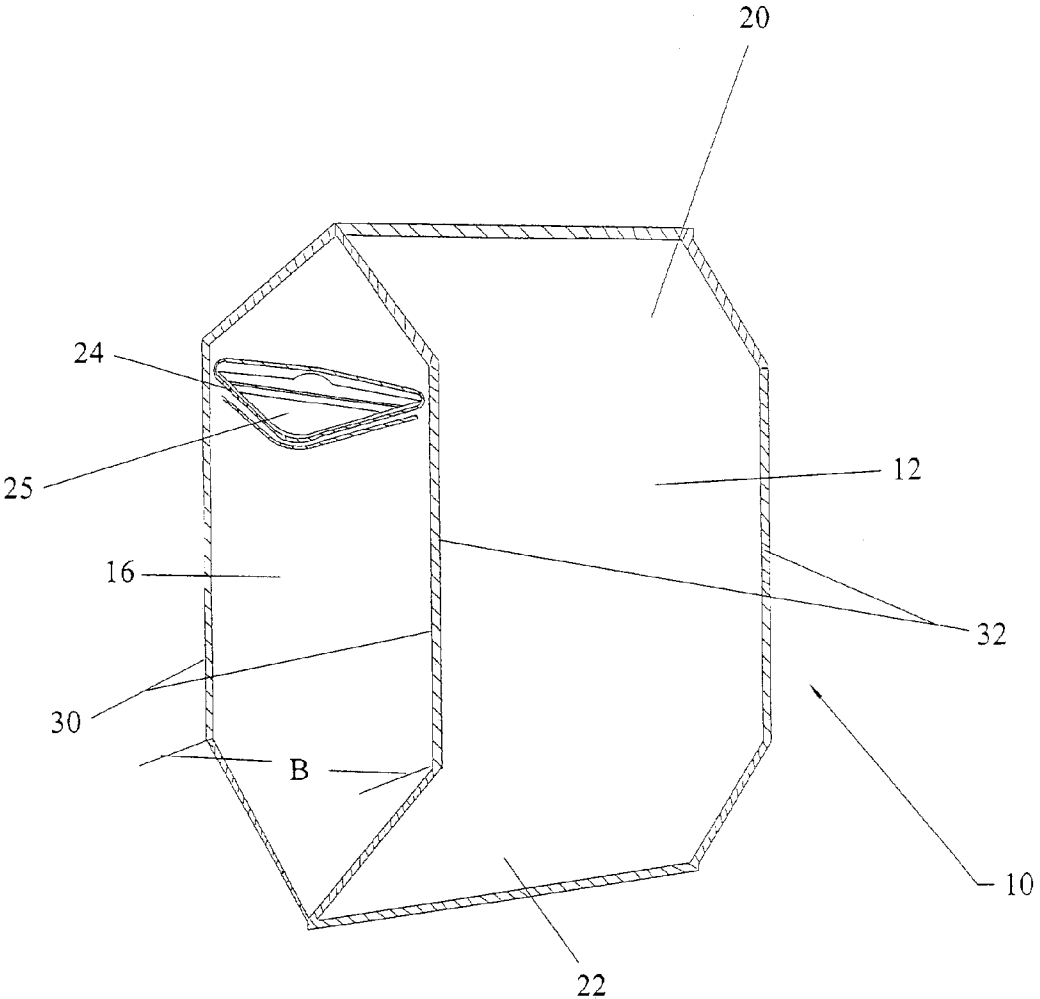
FIG. 11 is a perspective view of an embodiment of a flexible package having an open integrated transverse re-closeable device in accordance with the present invention.
Figure 12:
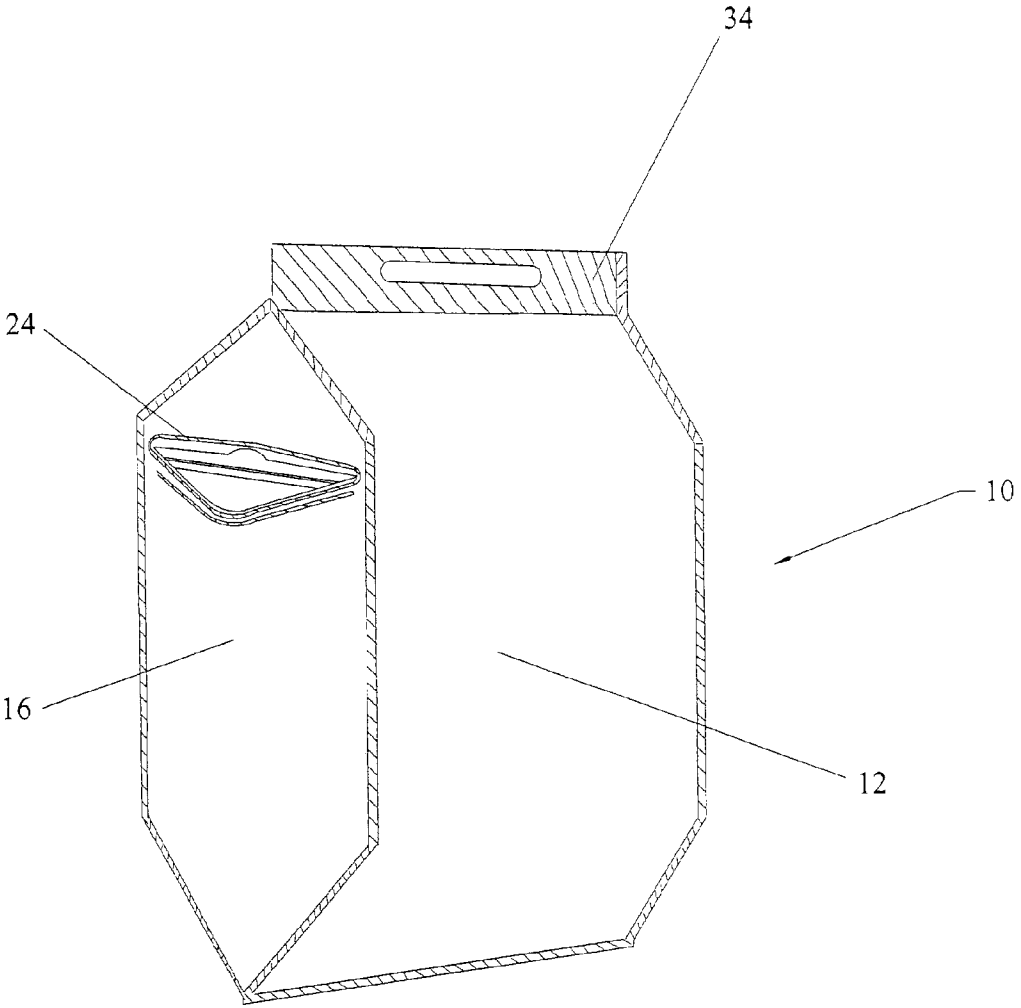
FIG. 12 is a perspective view of an embodiment of a flexible package having an open integrated transverse re-closeable device in accordance with the present invention.
Figure 16:
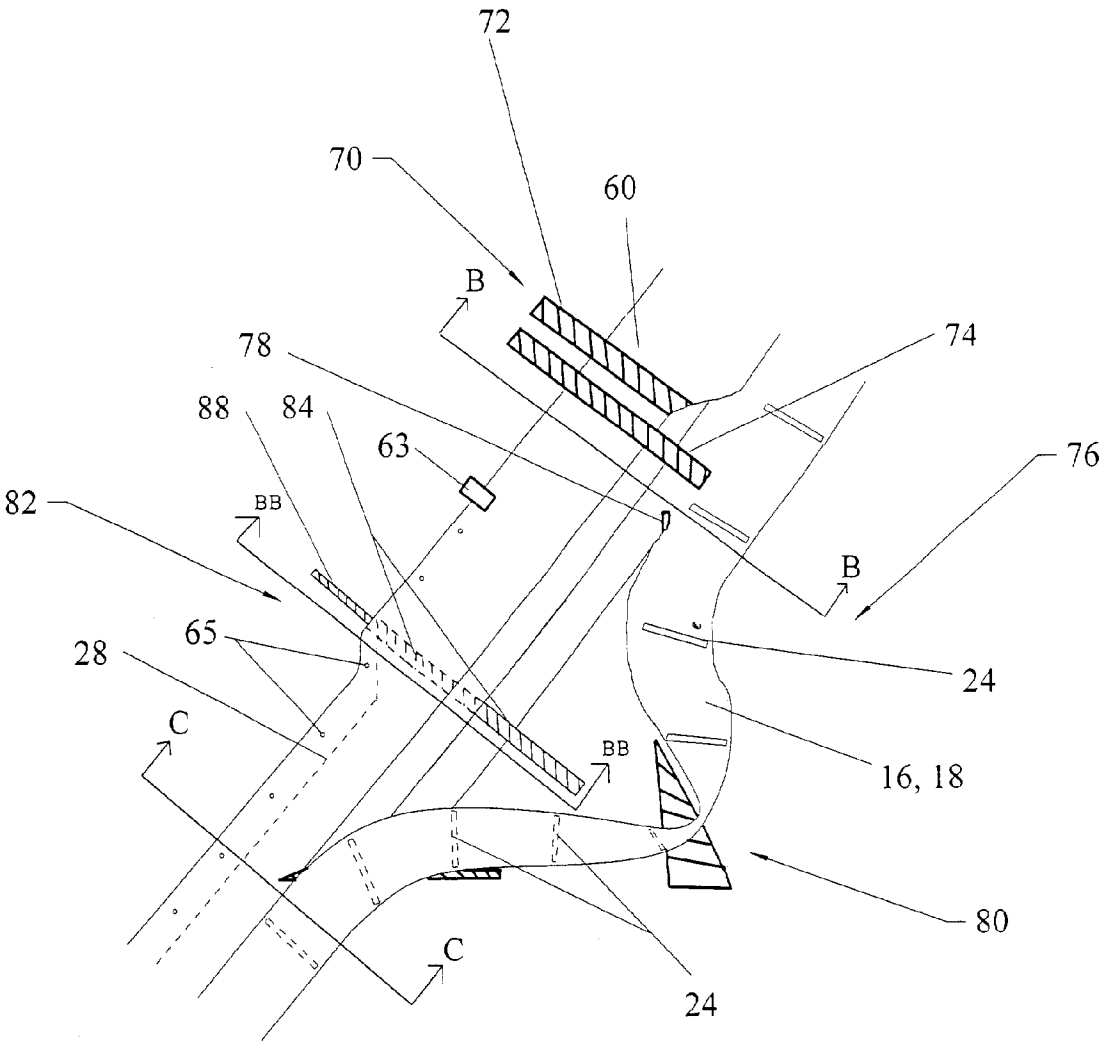
FIG. 16 shows particular manufacturing steps for forming a flexible package in accordance with an embodiment of the present invention.
Figure 19:
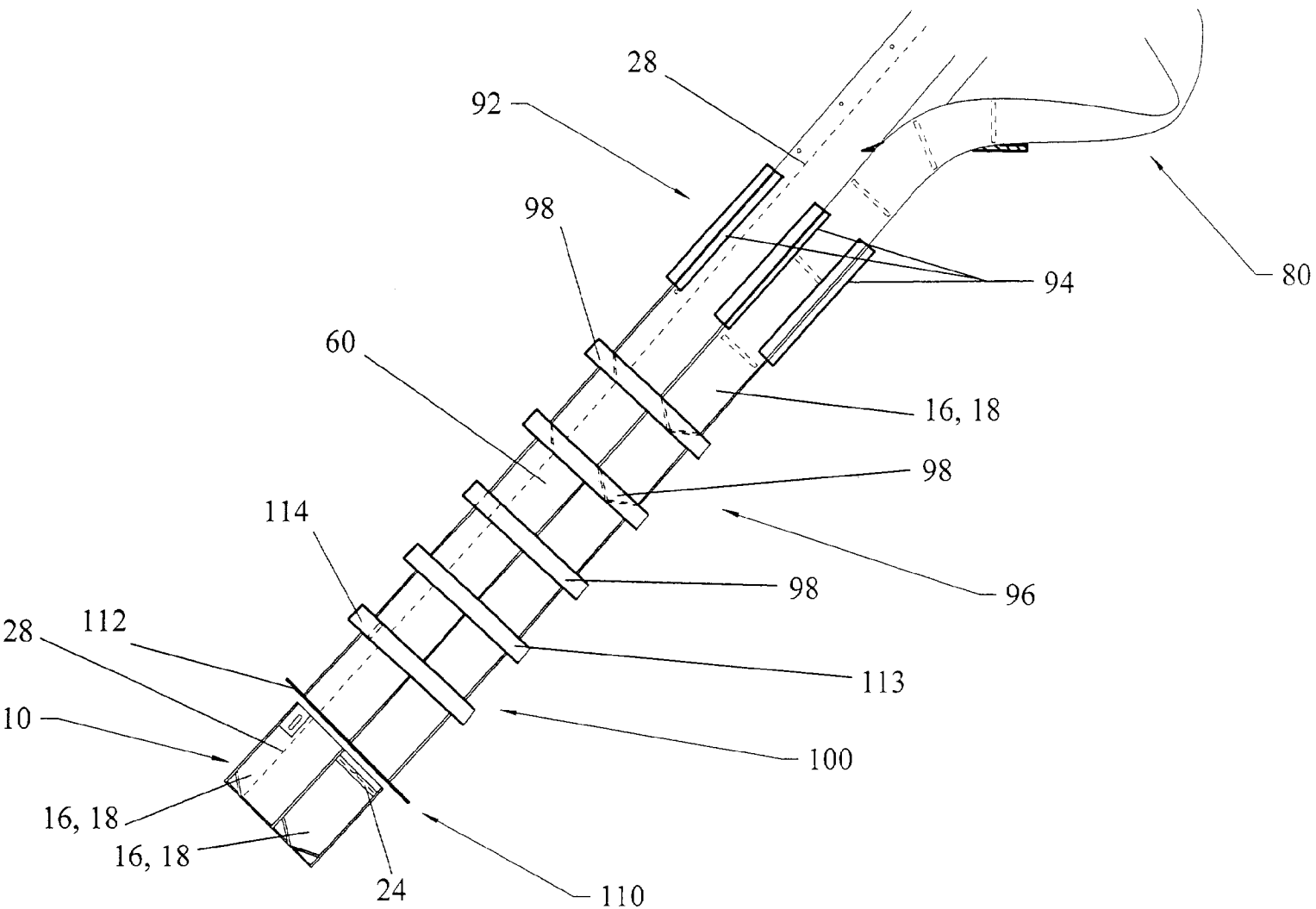
FIG. 19 shows particular manufacturing steps for forming a flexible package in accordance with an embodiment of the present invention.
Figure 21:
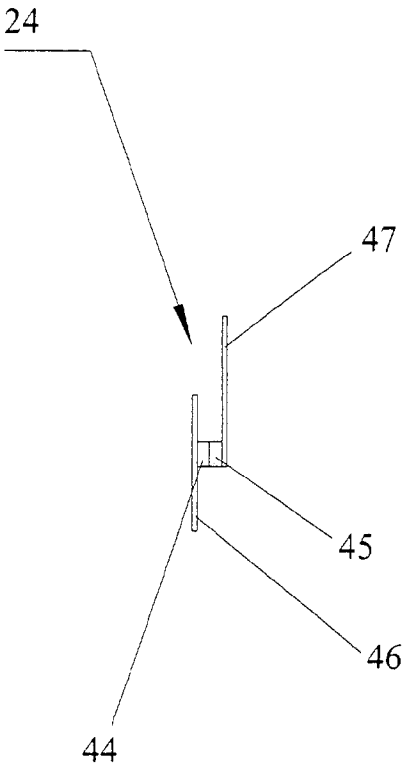
FIG. 21 is a side view of a re-closeable access device in accordance with an embodiment of the present invention.
Figure 20:
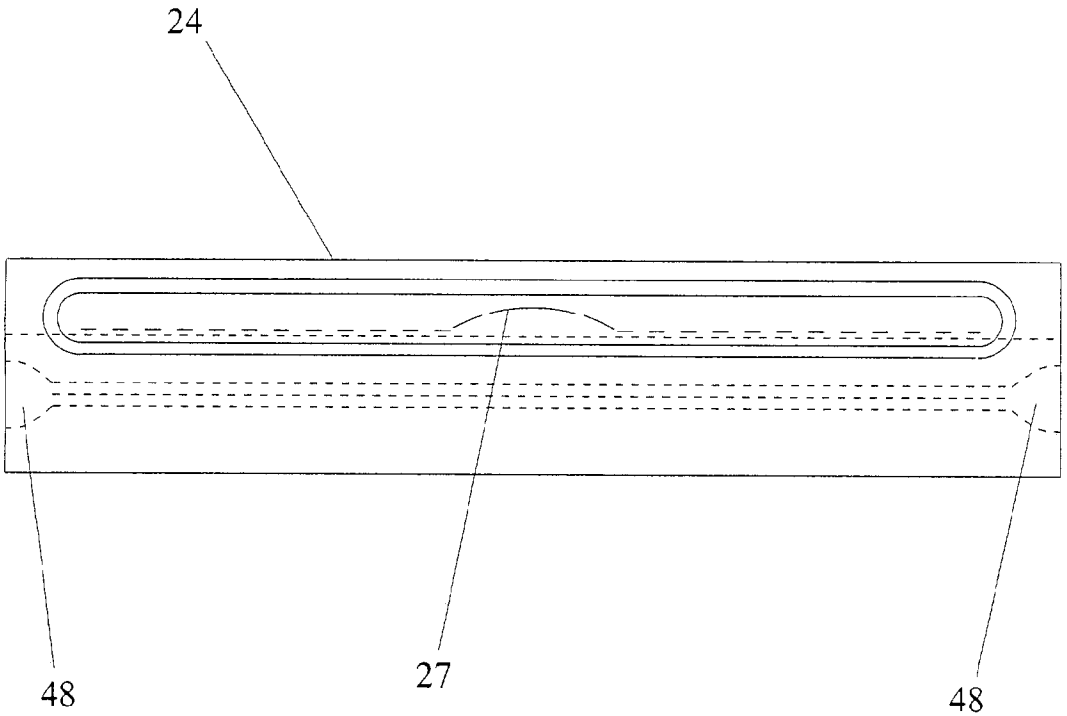
FIG. 20 is a front view of a re-closeable access device in accordance with an embodiment of the present invention.
Figure 22:
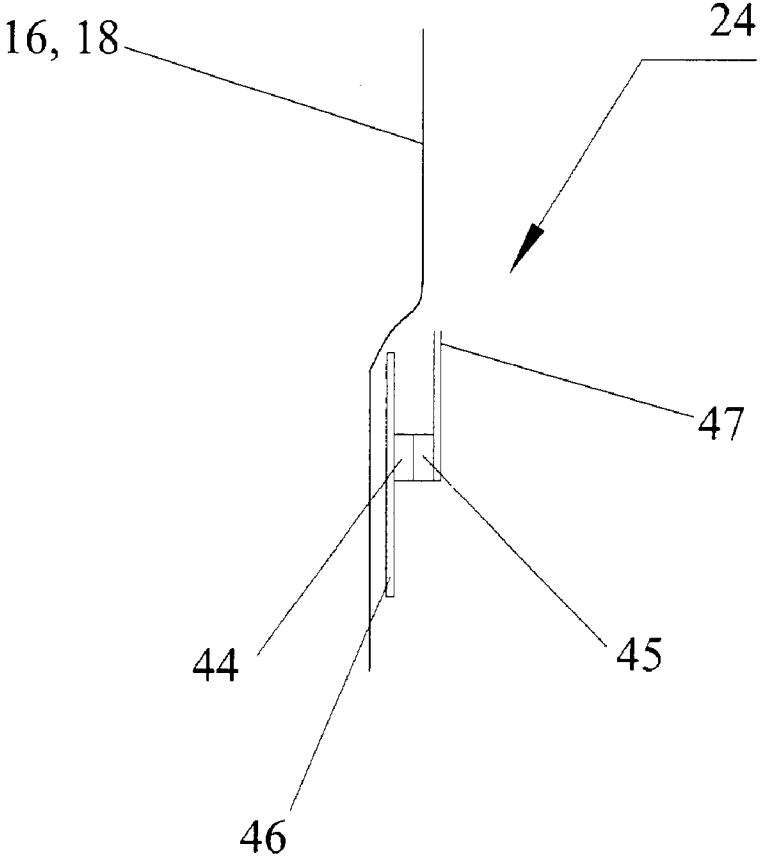
FIG. 22 is a side view of a re-closeable access device being attached/integrated to a side panel in accordance with an embodiment of the present invention.

It is possible in alternative embodiments to provide for a folding centerline 26 on the panels, which would provide for an expansion and collapsibility gusset line, as best demonstrated in FIGS. 8, 16 and 19, or a folded gusset line proximate one side, as best demonstrated in FIG. 8. The centerline 26 runs substantially parallel to the two sides or edges of the panels, wherein the side panels 16, 18 include side panel longitudinal edges 30 and the front and back panels 12, 14 include front/back panel longitudinal edges 32. After manufacturing embodiments with the folding centerline 26, the centerline 26 will typically be the point or line upon which the gusset panels will collapse or expand, facilitating efficient storage, shipping and handling. As material content is added to the internal cavity 25 of the package 10, the gusseted panel(s) expands out away from the centerline 26 to a maximum corresponding volume level for the cavity 25. This maximum volume capacity is dependent on the size of the package 10, the flexibility of the panel materials, the size of the corresponding gusset, and like factors.

The access device 24 is preferably a re-closeable device that is disposed on or integrated to at least one of the side panel portions, gusseted or non-gusseted, and capable of multiple re-closeable uses. Alternative embodiment of the access device 24 can be single or minimal use access devices. For instance, a peel seal as described herein can be included without a zipper interlock portion for such embodiments where re-closeability is not desirable or needed.

Figure 23:
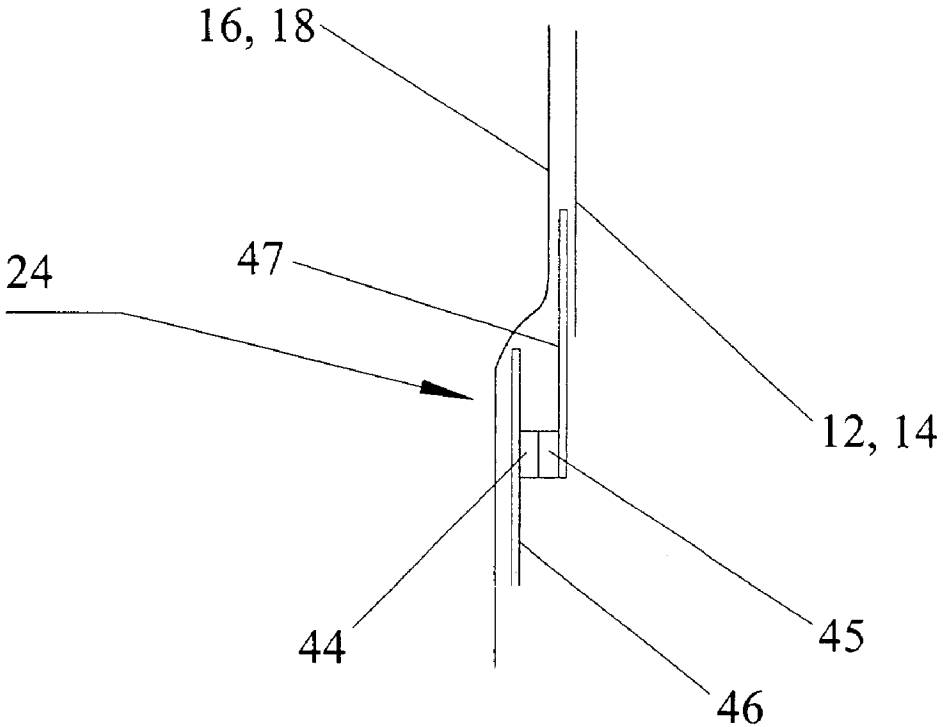
FIG. 23 is a side view of a re-closeable access device being attached/integrated to a side panel, back panel, and front panel in accordance with an embodiment of the present invention.
Figure 24:
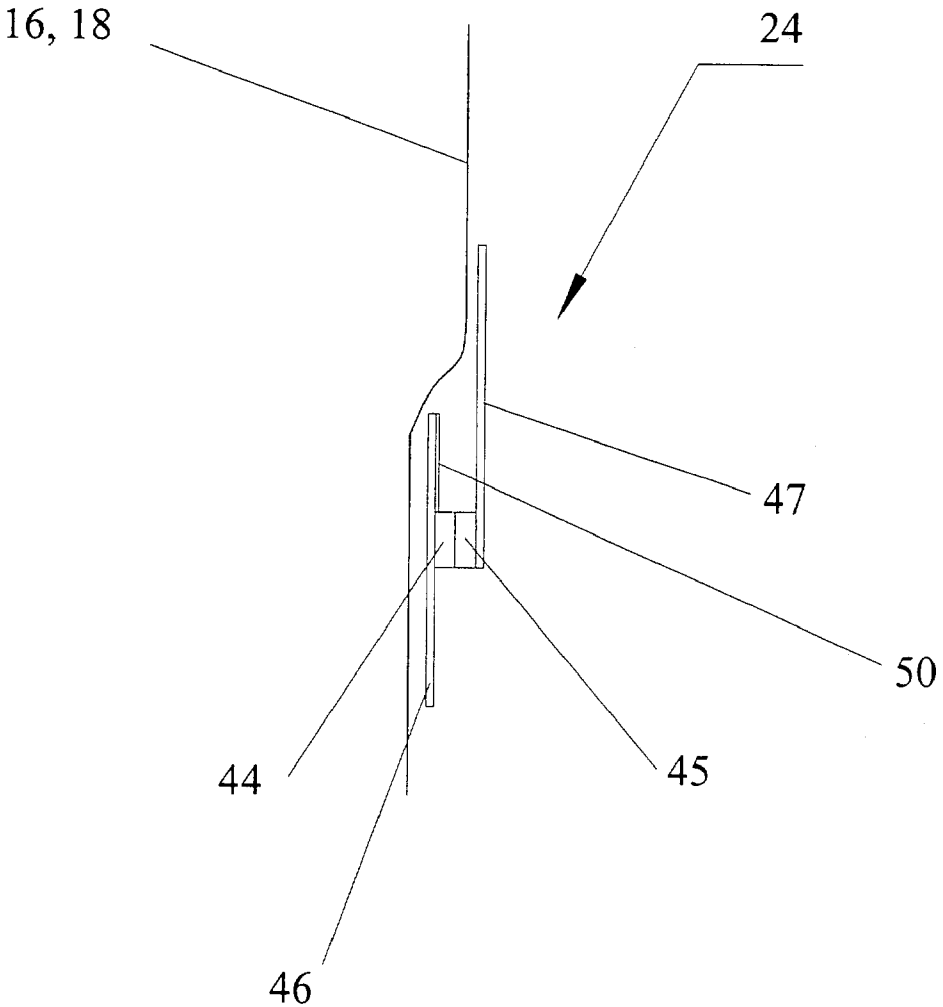
FIG. 24 is a side view of a re-closeable access device with an intermediate barrier being attached/integrated to a side panel in accordance with an embodiment of the present invention.

FIGS. 20–24 show various exemplary re-closeable "zipper" devices 24. Generally, these zipper devices 24 include a first interlock portion 44 and a second interlock portion 45. Each interlock portion 44, 45 can further include corresponding flanges for attachment to a selected inner wall portion of the flexible package 10. The first interlock portion 44 can include a front flange 46 and the second interlock portion 45 can include a back flange 47. In one embodiment, the front flange 46 is sealable to the inside wall of at least one of the side panels 16, 18 and the back flange 47 extends up beyond that sealable location for sealable attachment to the same side panel some distance higher, as shown in FIGS. 23–24.

The integration of the access device 24 into a side panel provides a substantial benefit over conventional packaging since a device 24 can be attached in a transverse relationship to the longitudinal edges (and the general machining/center line 26) of the panel. The re-closeable devices 24 are those devices known to one skilled in the art for providing entry into flexible sheet packages. While zipper-sealing devices are often described herein for demonstrative purposes, resealable adhesives/tapes, snap or screw cap device, snap fastening, hook and latch (Velcro®) fastening, a hinged spout, and other like techniques and devices known to one skilled in the art can be employed for use as the re-closeable access device 24. For instance, U.S. Pat. Nos. 4,909,017, 5,972,396, 5,461,845, 5,672,009, 5,782,733, 5,902,047, 5,954,433, and 6,177,172 are directed to some exemplary re-closeable devices, and other features and techniques for flexible packaging, and are therefore incorporated herein by reference. Conventional "peel seals" known to one skilled in the art can also be implemented in conjunction with access devices 24. Peel seals can provide oxygen, moisture, and like barrier protection by providing measurable joining of the inner surface of the flanges 46, 47 such that pulling away on the access panel, i.e., at a pull tab 27, separates the flanges 46, 47 to expose the device, i.e., the interlocking portions 44,45. This may be especially warranted if the flanges 46, 47 are made of a flexible packaging material that does not innately promote such protective barrier properties. Alternatively, or in addition to a peel seal, the flanges 46, 47 and other components of the device 24 can be constructed of various materials or material laminates rated to provide high barrier protection. For instance, polyvinylidene chloride, ethylene vinyl alcohol copolymer, and like films or laminates can be utilized in forming these device 24 components as such materials do provide increased barrier protection. It is preferred that the access device 24 be attached such that the device 24 runs perpendicular/transverse to the direction of the centerline 26. With regard to zipper devices 24 in particular, embodiments can utilize pressure sealable, slide sealable, and like devices. One example of a slide sealable zipper device is disclosed in U.S. Pat. No. 6,327,837, and is incorporated herein by reference. The re-closeable access device 24 can be a length some distance smaller than the width of the side panel to which it is attached, or it can substantially run the entire distance between the panel edges 30 (as preferred in those devices 24 being integrated into side gusset panels).

In preferred embodiments, the re-closeable access device 24 is attached to at least one of the side panels 16, 18 (gusseted or non-gusseted) such that the device 24 serves as a pour spout out the relatively smaller side panel, in comparison to the front 12 and back 14 panels. It should be noted that panels 16 and 18 are both adaptable for transformation into the access panel and are therefore interchangeably referred as such herein. The attachment/integration location of the device 24 on the side panels can be achieved manually or by manufacturing at any predetermined location on a panel. One embodiment will integrate the access device 24 into the region of the side panels $16,16_g$, $18,18_g$ proximate the top panel 20, as shown in FIGS. 1–12. Other embodiments will integrate the device 24 on a portion of the panel proximate the bottom panel 22. Further, it is envisioned that any one of the panels $N,N_g$, or a plurality thereof, can be equipped with the transverse re-closeable device 24. This flexibility in placement of the device 24 on a side panel 16, 18, and even along the surface of that particular panel, is made substantially possible by the single panel access feature of the device 24. That is, access into the cavity 25 is permitted through the access side panel 16, 18 rather than by releasing and joining two adjacent panels under conventional practice. Further, flexibility is promoted by the inherent adaptability derived from the transverse positioning of the device 24 with respect to the longitudinal edges 30 of the access panel 16, 18.

There are various methods for manufacturing a package 10 in accordance with the present invention. In one method, a predetermined length of device 24 is transversely attached/integrated to the "web" or panel portion of material by heat sealing, adhesive bonding, and the like. The device 24 can be sealed to the panel. The zipper can be placed in a predetermined position as described. This can be done manually or with the assistance of a system such as those machines and methods disclosed and incorporated herein.

Access Device Attachment/Integration

With regard to manufacturing or machine attachment, the access device 24 can be attached within a distinct process of a multi-purpose "pouch" machine, at a separate machine, or at a re-configured or modified stage within either of these machines. A commonly known machine manufactured by Hudson Sharp Machine Company to integrate the Inno-Lok® patented technology, incorporated herein, can be utilized. The apparatus and methods disclosed in U.S. Pat. Nos. 6,019,512 and 6,516,850 are therefore incorporated herein by reference. In addition, other machines consistent with that disclosed herein, and technologies for attaching such re-closeable devices to flexible packaging sheets or webs are also envisioned. For instance, methods for attaching and employing re-closeable devices and peelable seal technologies are disclosed in U.S. Pat. Nos. 5,050,736, 5,806,984, 5,829,884, 6,019,512, 6,044,621, 6,115,892, 6,224,262, and 6,270,257, and are therefore incorporated herein by reference.

It must be noted that the device 24 can be integrated with a web being used in a single web 60 process of manufacturing the package 10 (as processed in the manufacturing of FIGS. 13–19), or in one or more webs being used in a multi-web process (i.e., 2 or more distinct webs joined to form a unitary package 10). While the specifics processes are described in the incorporated references, generally, the web of material is placed on an unwind section of a machine and pulled through the machine by a series of draw rollers throughout the machine to perform the following overall steps.

A region of the web material 60 is perforated in a shape and size to allow later access to the access device 24, at perforation 49. A spool or series of devices 24 are placed on a separate unwind section of the machine and are preferably pre-crushed at the crushing region 48 (FIG. 20) where the zipper will be later cut off. Pre-crushing is done to terminate the opening of the zipper so as to prevent unwanted tearing of the attached film when the user later pulls open the device 24 during ordinary use.

After the device 24 has been pre-crushed, it is then fed into the machine, perpendicular/transverse to the web direction or longitudinal axis of the web edges and centerline 26, toward the web of material 60. The device 24 can then be fed into a vacuum station where the desired length of zipper can be cut off of the continuous spool. The vacuum station will then rotate (generally at approximately ninety degree increments) so that the device 24 is placed directly under the web of material 60 where it will be applied or integrated to a predefined region of the web material 60—i.e., the portion that will later be shaped to define the side access panel 16.

Next, a sealing head/device will generally come down and seal the panel/web region proximate the perforation 49 to the device 24. The web material 60 with the zipper device 24 integrated at the predefined panel locations is then pulled through the rest of the machine and rolled back onto itself with the zippers preferably attached at every perforated section 49 of the material. The perforation 49 provides easy access to the product through the inner cavity 25 of the package 10. As described in the incorporated references, previous processes may have included a peel seal to keep moisture and oxygen from getting to the product through the perforation sections 49 of the web material, and through the profile of the zipper. The web material roll 60 having the series of integrated devices 24 can then be placed at an initial feeding section of a pouch machine for further manufacturing and formation of the package 10.

Package Formation with Transverse Access Device in Side Panel

Formation of the package 10 can be obtained through selective folding and shaping of a single large web or from the bonding or joining of up to six individual webs (one for each of the six panel portions). In addition, a combination thereof is envisioned. For example, a side panel $16,16_g,18$, $18_g$ can be individual webs or sheets, while the other panels $12$–$22_g$ can be shaped out of one larger web or sheet. These examples are merely illustrative and various combinations can be implemented without deviating from the spirit and scope of the present invention.

In one preferred embodiment, a package 10 is constructed or shaped from a single web 60 of flexible material wrapped in a roll, wherein a plurality of access devices 24 are spaced and integrated along the predefined portion of the web 60, with the various key processing steps being depicted in FIGS. 13–19. It should be noted that various rollers and other feeding mechanisms and processing devices/techniques commonly known to one skilled in the art are not necessarily shown in the subject figures, to enable the Applicant to better show specific manufacturing processes implemented to create the transversely integrated devices 24 and packaging in accordance with embodiments of the present invention.

Figure 13:
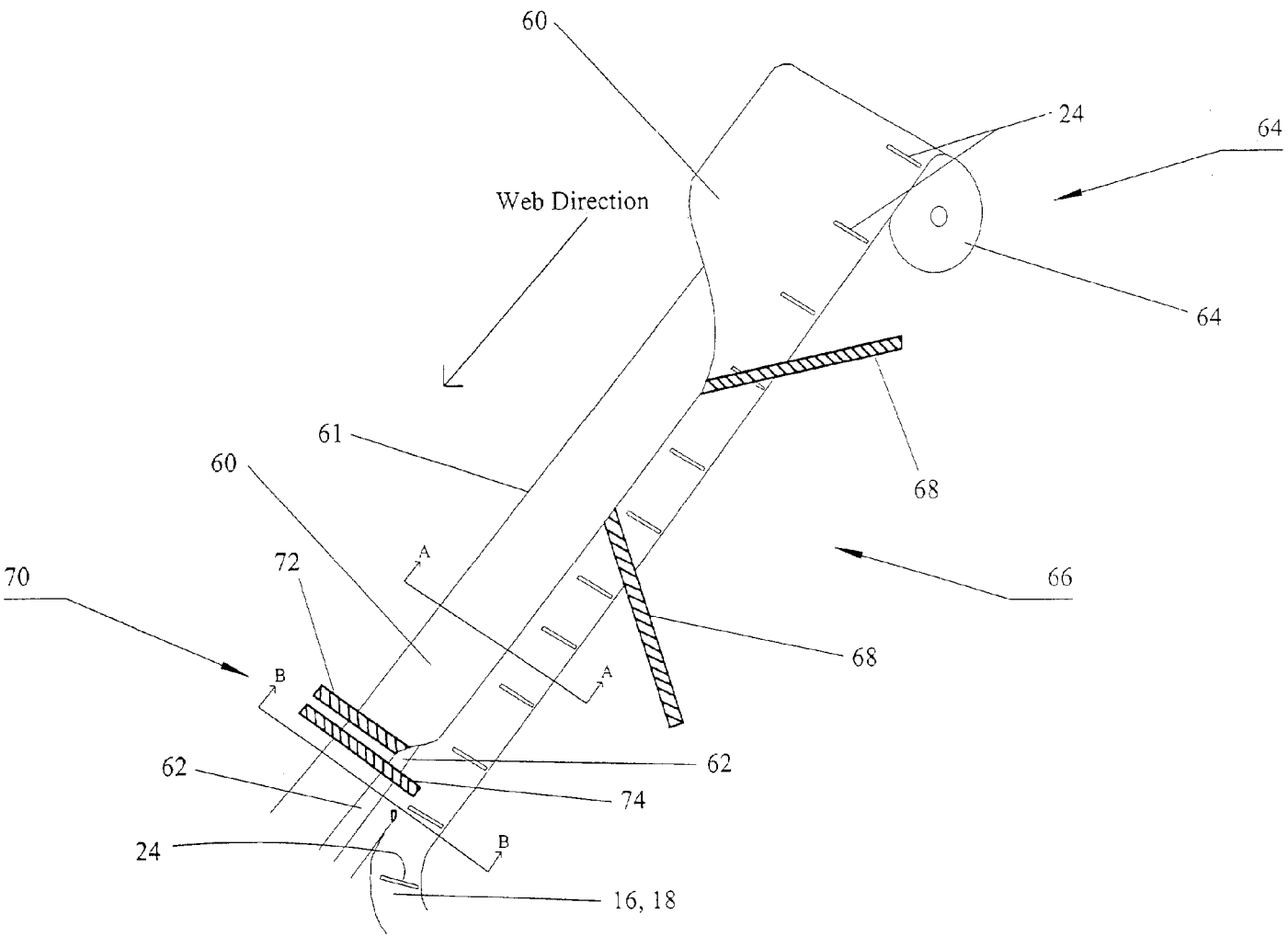
FIG. 13 shows particular manufacturing steps for forming a flexible package in accordance with an embodiment of the present invention.
Figure 14:
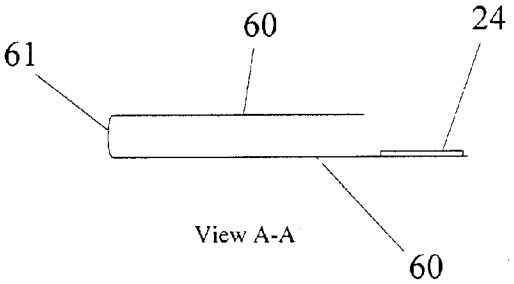
FIG. 14 is a view of section A—A from FIG. 13.

As shown in FIG. 13, the web 60 is attached at the back of a pouch or packaging machine at an initial roller entry station 64. The single web 60 is pulled through a machine and the panels N, $N_g$ are formed as it passes through an arrangement or series of plates, rollers, and other manufacturing stations and devices. The desired shapes and sizes of the panels are determined by these specifically-configured stations. Various pouch or flexible packaging machines known to one skilled in the art can be utilized and/or modified to create the package 10 with the transverse side panel re-closeable access device 24. For instance, one embodiment can utilize a form fill and seal machine ("FFS"). Examples of FFS machines known to one skilled in the art are horizontal FFS, vertical FFS, and the like. The advantage of FFS machines for particular applications are that the package or pouch 10 is formed, filled with material content in the inner cavity 25, and sealed all in one system. The use of other pouch, non-FFS, machines or systems are equally employable for the package 10 formation of the present invention without deviating from the spirit and scope described herein.

First, the main single web material 60 is unrolled from the roller entry station 64 and fed along a general web/machining direction for communication with a fold station 66, as shown in FIG. 13. The fold station 66 is generally designed to bring the sealant layers (i.e., an inner laminate surface) of the web 60 into contact with each other for formation and sealing later in the forming process. The fold station 66 can include angled brackets 68 positioned to initiate a main fold 61 of the web material 60 back onto itself a distance shy of a complete overlapping fold such that a non-folded region defining the side access panel 16 (with integrated device 24) is exposed. Various folding devices, techniques, and processes known to one skilled in the art are envisioned for use at this initial folding stage 66. In one embodiment, the material 60 can be slit or cut away along the fold 61 such that the material 60 is divided into two distinct web portions laying upon each other during the remaining manufacturing/forming processes.

Figure 15:
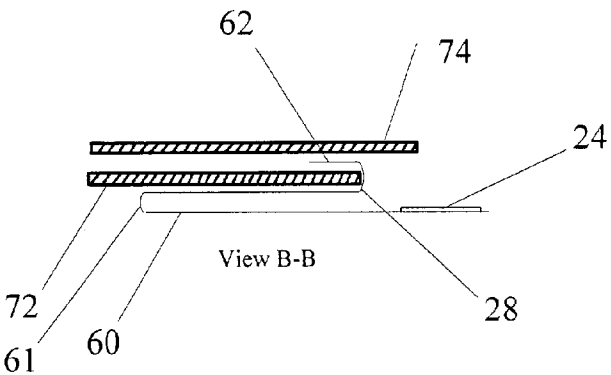
FIG. 15 is a view of section B—B from FIG. 13.
Figure 18:
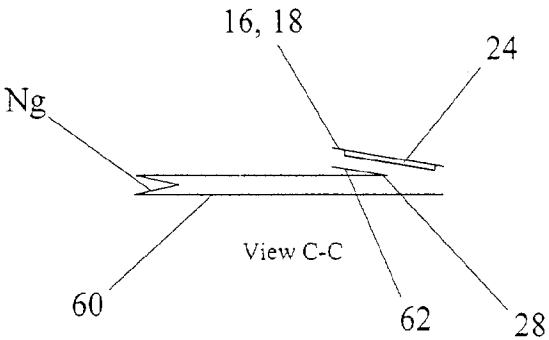
FIG. 18 is a view of section C—C from FIG. 16.

Next, the folded web material 60 continues to an edge folding station 70. The edge folding station 70 can include a first parallel bracket 72 and a second parallel bracket 74, as shown in FIGS. 13 and 15. Each of the brackets 72, 74 are perpendicularly aligned with the plane of the web material 60 and machining or web running direction. As the relatively large folded portion of the material 60, as defined and divided by the main fold 61, arrives at the edge folding station 70, the first bracket 72 initiates a small edge fold 62 (i.e., approximately ½ of distance B) of the material back onto itself, wherein the edge fold 62 is formed and maintained by the second bracket 74. This edge forming is made possible by the spacing of the second bracket 74 a measurable distance above and lateral to the first bracket 72, as best shown in FIG. 15. It should be noted that spatial exaggerations are provided in the figures for illustrative purposes, including FIGS. 15 and 22–24. As the edge fold 62 traverses through the space defined by the opposing brackets 72, 74, the material 60 proceeds on to a separation stage 76. The small edge fold 62 is provided to again selectively position or direct the sealant layer of the web where a later sealing step may be performed to join panel portions and/or form the package 10. In at least one embodiment, the small edge fold 62 and corresponding process forms a gusset line 28 in the web of material 60, as shown in FIGS. 15 and 18. Unlike a side panel gusset, this gusset line will be formed in either of the panels 12, 14, depending on orientation of the web 60 within the machine. As such, a gusseted panel $12_g$ or $14_g$ can be included, as shown in FIG. 8. This alternative gusset line 18 is proximate the edge 32 of the front or back panel (back panel $14_g$ in FIG. 8) that is in turn proximate the access panel with the integrated device 24. Again, such a gusseted panel $12_g$ or $14_g$ can provide expansion options for the package 10 not available with conventional packages.

At the separation stage 76, as shown in FIG. 16, a cutting/splicing device 78, such as a razor blade, is positioned to contact and cut away the non-folded side access panel 16 from the main web 60. At this point in the forming process, the separated side access panel 16 is directed away from the main web material 60 and on to a turning station 80. The turning station 80 is generally adapted and positioned to turn the side panel 16 (with integrated device 24) over or upside down in relation to its original upright running position to again position the sealant surface or layer of the panel 16 at its edges 30 for later sealing processes. In addition, the turning station 80 is positionally adapted and shaped to direct the now-turned side panel 16 back toward the machining direction of the main web material 60 upon completion of the turning step. If indicia is utilized to register or align the panels, an adjustable roller and register system known to one skilled in the art can be employed such that adjustment of the timing and distance of travel for the turned side panel 16 back to the main web 60 is related to corresponding and alignable indicia on the main web 60. Separating and turning the access panel 16 enables proper formation of a side-pour package 10 without requiring often unwanted bending of the access panel 16. This, in turn, protects the re-closeable device 24, wherein conventional bending of side panels during formation would prove problematic for the transverse side panel re-closeable device of the present invention.

Figure 17:
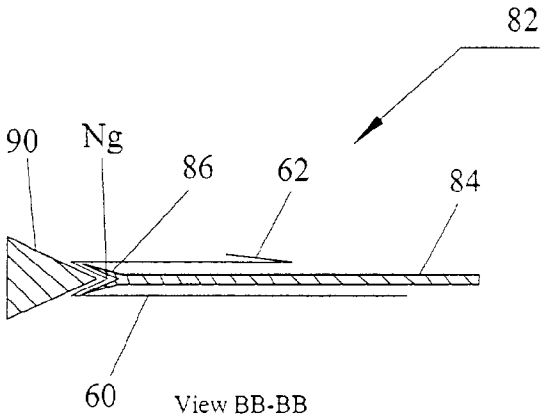
FIG. 17 is a view of section BB—BB from FIG. 16.

While the side panel 16 is being turned over at the turning station 80, the main web material 60 can be directed through a gusset station 82, as shown in FIGS. 16–18. First, a portion of the main web 60 proximate the main fold 61 can be punched by punching device 63 to create a plurality of spaced holes 65 along the main web edge. These holes 65 bring the interior sealant materials/layers of the front 12 and back 14 panels into contact such that the contacted material at the holes 65 can be later sealed together by a heated seal bar, generally the seal bar applying a, handle at accessory station 100. Such a punch process will keep the folded portion around the holes 65 together, preferably near the top of the package 10, for a later sealing station. Embodiments that do not implement the punch process for including the holes 65 are envisioned when the top portions of panels 12, 14 are not to be joined for a handle or other reasons.

After such a punch process, at the gusset station 82, a portion of the main web material 60 defining the second side panel 18 can be gusseted to form panel $\mathbf{18}_g$. This gusset feature is generally achieved using an opening bracket 84 and a tucking device 88. The opening bracket 84 can include a v-shaped end portion 86. The tucking device 88 can include a generally conical portion 90 shaped and sized to insertably engage the v-shaped end portion 86 of the opening bracket 84.

Referring primarily to FIG. 17, the opening bracket 84 is generally inserted into the folded web material 60 from the accessible portion distal the main fold 61 such that the v-shaped end portion 86 is brought into abuttable contact with the interior portion of the fold 61. At this point, the tucking device 88 can be brought into engagement with the v-shaped end portion 86. Since the end portion 86 is positioned inside the web material 60 and the tucking device 88 is outside the fold 61, engagement of the conical portion 90 inward creates the gusset and gusset line 28 conforming to the shape and size of the v-shaped end portion 86. This gusset addition to the side panel $\mathbf{18}_g$ will also generally bring the holes 65 inward toward the gusset line 28, thus allowing for concealment of the holes 65 when the relevant surfaces of the panels 12, 14 proximate the holes 65 are later sealed.

Next, the edges of the web material 60 and respective edges of the side panel 16 are brought together and joined at a sealing station 92. Again, heat sealing, adhesive bonding, and like joining techniques and methods are envisioned. For example, FIG. 19 demonstrates various longitudinal heat seal bars 94 in alignment and positioning to seal the side panel 16 to the main web 60 and/or to seal the comers of the side gusseted panel $\mathbf{18}_g$. The longitudinal seal bars 94 are in line with the machining/web direction of the system. Upon downward contact of the bars 94 against the respective portion of the web 60 or side panel 16, designated comers bonds and longitudinal seams are created. In addition the station 92 can include trimming devices such as known or standard cutters or blades for trimming off excess material from the panels edges of the package 10. This trimming is often utilized by those skilled in the art to accommodate for imprecision in the alignment of joined panel portions during flexible packaging formation. To join and seal the bottom of the shaped package 10 and to finalize other transverse seals after employment of the longitudinal seal bars 94, a transverse bottom seal station 96 is implemented.

The transverse seal station 96 generally includes at least one transverse seal bar 98 perpendicularly aligned with respect to the machining direction and longitudinal plane of the web 60. The transverse bars 98 and sealing techniques known to one skilled in the art for providing k-seals, straight seals, and other like bonding configurations for flexible packaging can be utilized without deviating from the spirit and scope of the present invention. Further, bonding techniques, intermediate protective heat plates/materials, and other known methods can be implemented as well during bonding and joining of the various panels N, $N_g$. Upon completion of acceptable sealing or bonding of the bottom portion of the package 10, a cooling bar 113 can be brought into contact with the previously heated regions to lower the temperature at said bonds. Following cooling of a designated portion of the web 60, additional accessory and package design stations, such as handle cutout stations 114, vent hole stations, valve stations, and other stations known to one skilled in the art can be employed.

As demonstrated in FIGS. 1–5, a handle can be included that provides increased stability and strength at a portion of the package 10 distal the access panel 16 with the access device 24. In one embodiment with the handle integrated at the top portion of the package 10 distal the access panel 16, the area around the handle 34 provides bonded sealing of four flexible material layers. Specifically, the side panel $\mathbf{18}_g$ and the front 12 and back 14 panels around the handle 34 opening are joined. Folding inward the top portion of the side panel $\mathbf{18}_g$ at the gusset line 28, as is shown in FIG. 8, provides two joinable sections of the panel $\mathbf{18}_g$. An inner surface of the back panel 14 is joinable to an inner surface of one proximate section of the side panel $\mathbf{18}_g$, while an inner surface of the other section of the panel $\mathbf{18}_g$ is joinable to a proximate inner surface of the front panel 12. Joining of these described web surfaces provides a 4-layer material bond for which to integrate the handle aperture 34. This process significantly meets the needs of the industry by reducing material and manufacturing costs. Costs are reduced as the conventional method is avoided. The conventional method of strengthening the area around handles is to selectively form the package with at least one additional layer of material at and around the designated area for the handle. Such a technique is cumbersome, and requires additional manufacturing to join that material for such a limited purpose. The present invention innately provides for this strengthened region around the handle 34 at the gusseted panel $\mathbf{18}_g$ distal the access panel 16.

In those embodiments including a valve system, a "one-way" valve can be integrated that permits the evacuation of gases without letting potentially damaging air into the package 10. Various valve devices and methods understood by one skilled in the art for controlling air and gas flow in and out of flexible packaging can be employed. For instance, U.S. Pat. Nos. 5,059,036, 5,147,272, 6,023,914, and 6,021,624 disclose various packaging valves and are therefore incorporated herein by reference. In addition, there are various other methods known to one skilled in the art for integrating a valve to a package that can also be employed. Moreover, various other techniques of eliminating or evacuating air, i.e., using specifically shaped and sized channels and/or pockets within the package 10 to control fluid communication between the inner cavity 25 and the outside environment, can be implemented without deviating from the spirit and scope of the present invention.

Once the package is sealed and formed by the steps and stations of a particular manufacturing step, a cut-off section 110 is generally required. At the cut-off station 110, a cutting device 112, such as a blade or knife, cuts the now-formed (but collapsed) package 10 from the larger web of material 60. Various flexible sheet and gusset packaging techniques, apparatus, and methods understood to one skilled in the art can be employed for forming the package 10 from a large single web of material without deviating from the spirit and scope of the present invention. A key feature of this preferred single web process is that the package can be manufactured without folding the side panel 16, or 18, designated to integrate the re-closeable device 24. It should also be noted that this single web process can easily be modified into a forming process that joins two distinct webs. In such an alternative embodiment, the side access panel 16 is fed into the machine separately rather than being cut away from the larger web 60 at the separation station 76.

In another embodiment and process, a plurality of webs are used to define the panels 12–22, and ultimately package 10. For example, separate webs of material can be fed through the machine for the front panel 12 and the back panel 14. In addition, two individual webs of material can be fed through the machine for the side panels, gusseted $\mathbf{16}_g$,$\mathbf{18}_g$ or non-gusseted 16,18. In addition, further separate webs can be used to form bottom 22, and top 20 panel, and even gusseted bottom $\mathbf{22}_g$ and top panel $\mathbf{20}_g$.

When using a plurality of webs of material, each of the panels 12, 14, 20, 22 (whether as one or multiple webs) will generally be fed straight into the machine from an unwind section of the machine, and the side panels $\mathbf{16}$,$\mathbf{16}_g$,$\mathbf{18}$,$\mathbf{18}_g$ will come in from another unwind section where they can be folded longitudinally in half and placed between the front 12 and back 14 panels. However, if a fold is not desired, the edge-folding station described herein can be implemented to join the panels N, $N_g$ having the device 24. Again, the access device 24 has already been integrated into at least one of the panels 16, 18.

Next, each of the plurality of webs will be typically sealed together by at least two sets of positioned sealing mechanisms, such as seal bars. These sealing mechanisms can heat seal all corners/edges of the package together. For instance, side panel 16 edges 30 can be sealed to adjacently aligned edges 32 of the back panel 14 and the front panel 12, and likewise with side panel 18, $\mathbf{18}_g$. Again, as stated with the single web method, additional features can be added to the package 10 through further manufacturing steps. Various flexible sheet and gusset packaging techniques, apparatus, and methods understood to one skilled in the art can be employed for forming the package 10 from a plurality of material webs without deviating from the spirit and scope of the present invention.

Figure 4:
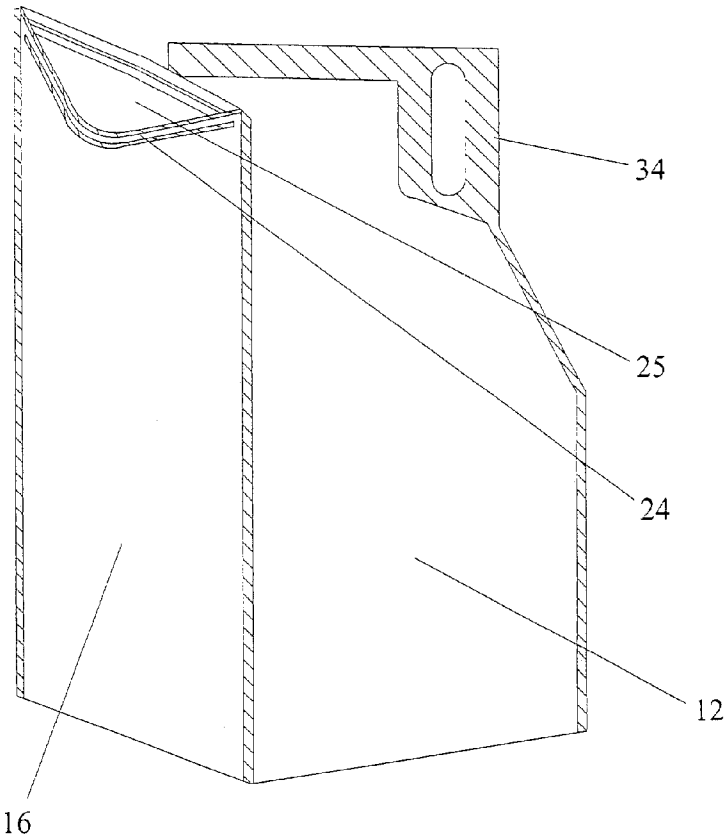
FIG. 4 is a perspective view of an embodiment of a flexible package having an open integrated transverse re-closeable device and in accordance with the present invention.
Figure 3:
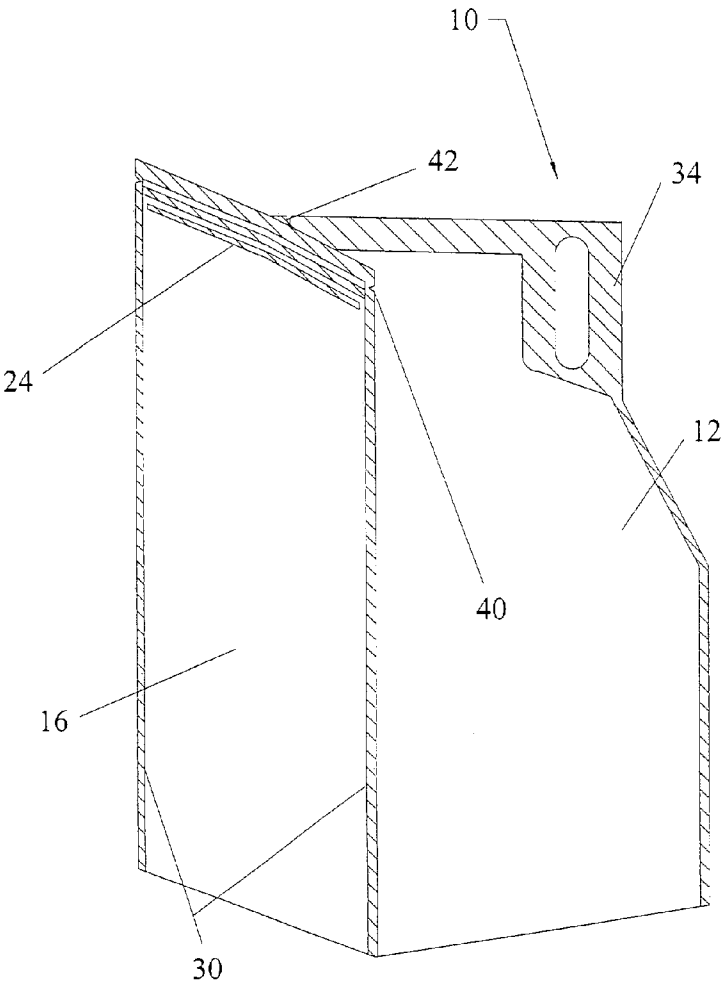
FIG. 3 is a perspective view of an embodiment of a flexible package having an integrated transverse re-closeable device and tear notches in accordance with the present invention.
Figure 5:
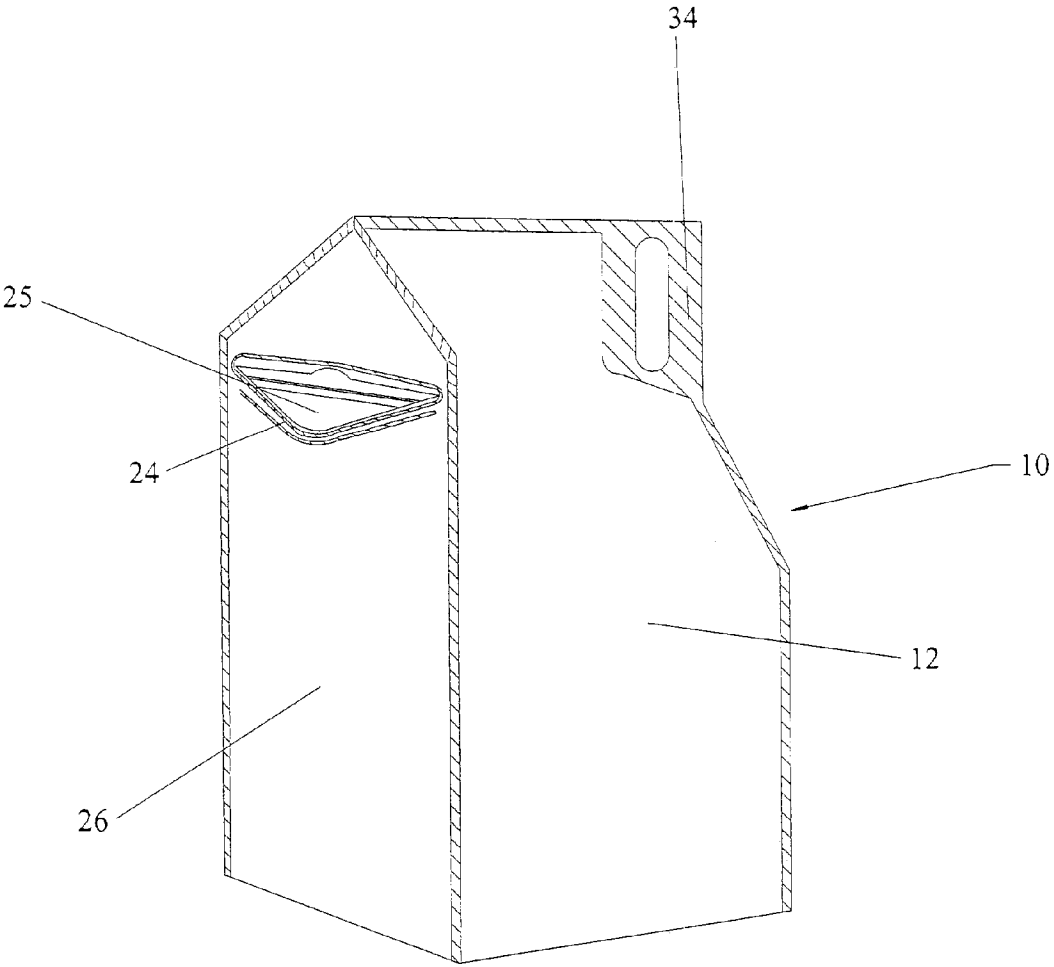
FIG. 5 is a perspective view of an embodiment of a flexible package having an open integrated transverse re-closeable device in accordance with the present invention.
Figure 6:
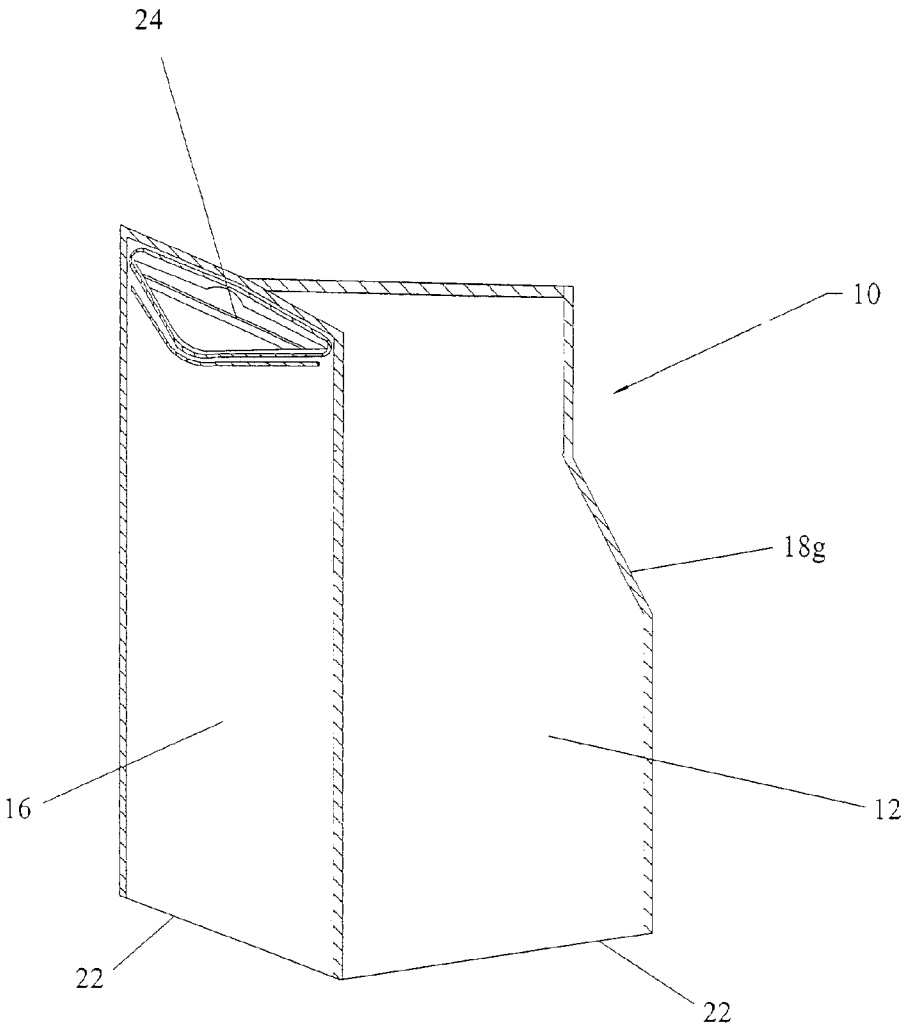
FIG. 6 is a perspective view of an embodiment of a flexible package having an open integrated transverse re-closeable device in accordance with the present invention.
Figure 7:
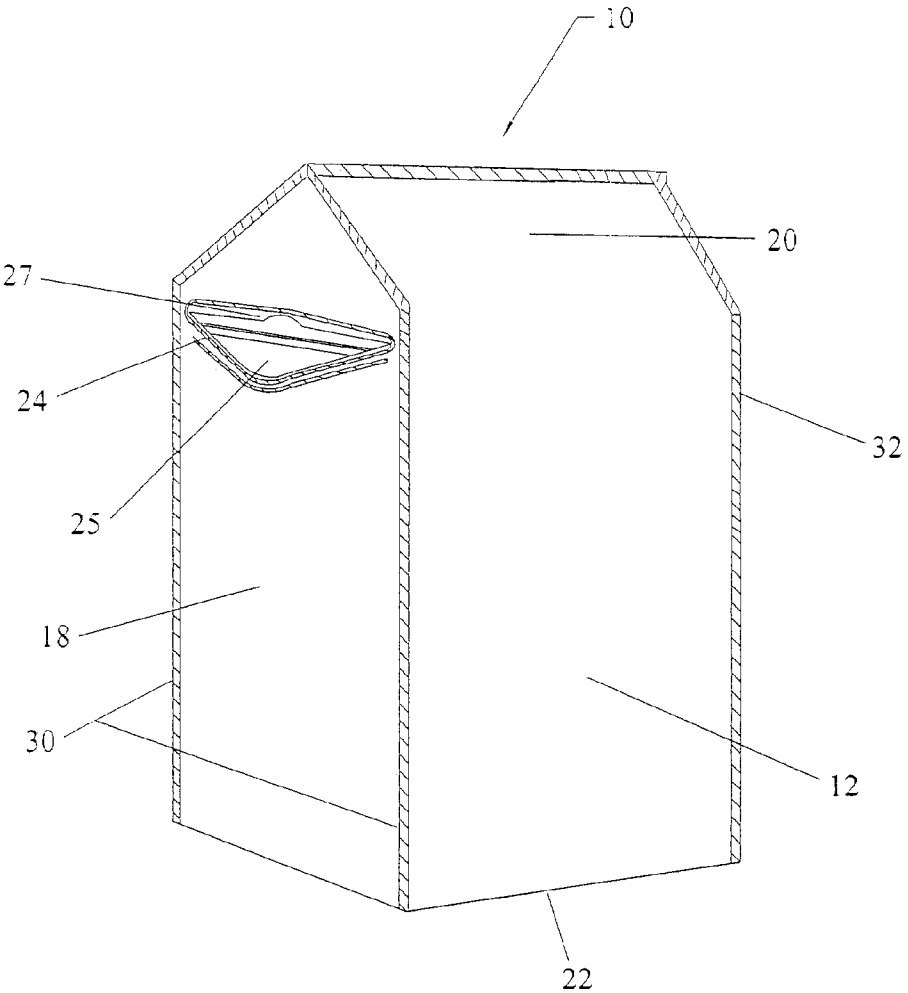
FIG. 7 is a perspective view of an embodiment of a flexible package having an open integrated transverse re-closeable device in accordance with the present invention.

In addition to attachment of the device 24 to form a specific access panel $\mathbf{16}$,$\mathbf{18}$,$\mathbf{16}_g$,$\mathbf{18}_g$, and the formation of the package 10 using various described techniques, alternative embodiments can implement a "bag-top" configuration, as shown in FIGS. 3–4. With such an application, the device 24, generally a re-closeable zipper device 24 is attached to the web of material 60 in a method as described herein. However, the front flange 46 of the zipper usually is the only part of the zipper permanently sealed to the side access panel 16, 18 during the initial steps of package formation. The back flange 47 of the zipper, not necessarily sealed to the side panel 16, 18, can be joined to or carried together with the front flange 46, as described below.

The significant difference of the bag top embodiment of the present invention is that front flange 46 of the zipper device 24 can be attached to the side panels 16, 18 and the back flange 47 can be partially attached to the front panel 12, and partially attached to the back panel 14, as shown in FIG. 23. With this attachment of the back flange 47 to both panels 12, 14 the device 24 is integrateable proximate the uppermost portion of the package 10 and the device 24 is sealably anchored to three panel portions (i.e., 12, 14, 16). As such, a user can uniquely open up the "top" of the package 10 through the side access panel 16, 18, (including engaging various tear notches or slits described herein) rather than the conventional bag top method of accessing the top through the large front and back panels. A bag top opening through the side panel provides beneficial pouring efficiency as the side panel is measurably smaller in size than the front and back panels, thus creating an ideal pour channel. In one embodiment, the initial attachment or integration of the device 24 to the web 60 or side panel will involve initially sealing only the front flange 46 of the device 24 to the side access panel 16, 18. The only point of attachment initially for the back flange 47 is the selective engagement of the first interlock portion 44 and the second interlock portion 45. As such, the back flange 47 is still free of an attachment seal to the front 12 and back 14 panels. When the web of material 60, and the defined side panel 16, 18, is formed in the machine (i.e., pre-made pouch machine, FFS machine, and the like) a seal bar will later seal the back flange 47 of the zipper device 24 to the panels 12, 14. This can be done at the transverse seal station 96 described herein. In other embodiments of the bag-top configuration, the back flange 47 can be merely sealed high to the panels 12, 14 such that this limited seal is later torn away by the user upon tearing notch 40 inward and upon opening the device 24.

In those embodiments having this bag-top configuration, as demonstrated in FIGS. 3–4, at least one tear notch 40, and preferably two, extends into the longitudinal edges 30 proximate the upper portion of the side panel 16, 18 serving as the access panel. This at least one tear notch 40 facilitates tearing of the top portion of the side panel, thus exposing the integrated re-closeable device 24, as shown in FIG. 4. Tearing away the tear notch 40 also can tear away a portion of the back flange 47 above the seal attaching the back flange 47 to the panels 12, 14. In addition, a top tear slit or notch 42 can be included proximate the top portion of the package 10, as shown in FIG. 3. The top slit 42 prevents tearing of any attached or adjacent panel portions by generally isolating the pour spout device 24 and the pressures put upon it during use. Further, various embodiments of the bag-top configuration can employ a peel seal similar to that described herein.

In some bag-top embodiments of the present invention where the user will be cutting or tearing off the top seal 40 of the package 10, the zipper flanges 46, 47 can include a heat resistant coating, lamination, tape, and the like. For instance, a barrier layer or film 50 can be positioned intermediate the flanges, on either or both flanges, to prevent the flanges from sealing together during any adhesive or heat sealing processes performed on the corresponding panel and/or re-closeable device 24. FIG. 24 demonstrates an embodiment with such a barrier layer 50. Inclusion of the intermediate barrier 50 between the front flange 46 and the back flange 47 can prevent the two from bonding or sealing together when a seal bar is utilized from outside of the side panel 16 to bond the front flange 46 to the inner surface of the side panel 16. As such, the intermediate barrier 50 will prevent bondable heat transfer through to the back flange 47. It will be understood by one skilled in the art that such a heat resistant material and process can be implemented at other panel portions, packaging materials, and device attachments of the present invention in order to eliminate or substantially minimize the bonding of two materials, devices, or portions of the package due to adhesives, heat, and the like. Various methods and techniques for heat resistant protection are disclosed in U.S. Pat. Nos. 6,350,058 and 6,065,873, which are incorporated herein by reference.

Various figures and descriptions disclose handles and other accessories. However, it must be noted that these features are merely illustrative in nature and may be placed in varying locations and under varying configurations, and still be consistent with the present invention. In addition, the shape and configuration for the top portions are also merely illustrative and can be altered without deviating from the spirit and scope of the present invention. Any of the panel portions, or selected regions thereof, can include various aesthetic and functional graphics, such as logos, instructions, advertising, bar codes, and the like. These graphics can run transverse, parallel, or even in a diagonal orientation to the longitudinal panel edges discussed herein.

In either the multi-web or single web embodiments of the present invention, it is envisioned that at least one of the potential sealing tasks described for joining web portions or edges can be left either unsealed or only partially sealed for ease-of-filling by the packager or end user. This provides the packager with a convenient filling area and means. For instance, the top region joining the back 14 and front 12 panels (FIGS. 8–9), or the side panel edges 30 of one of the side panels 16, 18, gusseted or non-gusseted, can be left unsealed for later filling by the packager. After filling, the unsealed edges can be easily and selectively sealed.

In addition to being left initially unsealed to enable later filling by a packager, the unsealed panels N, $N_g$ can be manufactured, cut, or formed such that unsealed edge 30, 32 extends some measurable distance to enable operable engagement with a "wicket" hook device or machine. This extended material or area of the panel can include at least one, and typically two, punched holes for hanging on the wicket for filling. Hanging of the package 10 on the wicket by the unsealed panel portion extension enables filling of the inner cavity 25. Following filling and sealing, the extension length of the relevant panel portion can be cut or torn off. Such extension can be provided for any of the panel edges of the package 10, including the panel edges 30 of the side panels 16, 18. This is an improvement over known packaging wicket techniques and devices since the extended edge material can be included with a side panel portion 16, 18, gusseted or non-gusseted, to implement a side-wicket system. As such, the specialized seals (i.e., k-seals) often employed in sealing the top 20 or bottom portion 22 of the package 10 can be applied by the flexible package manufacturer, thus leaving only the relatively simple edge seal of the side panels 16, 18 for the end wicket packager to complete.

The present invention may be embodied in other specific forms without departing from the spirit or essential attributes thereof, and it is, therefore, desired that the present embodiment be considered in all respects as illustrative and not restrictive. Further, it is envisioned that various depicted steps can be performed in differing substantive and sequential order.

The invention claimed is:

1. A flexible package formed by a plurality of attached flexible panel portions forming an inner cavity capable of holding material contents, comprising:

a front panel portion having a front panel top edge;

a back panel portion having a back panel top edge, the front and back panel top edges operably connected to define a narrow top edge seal;

a side portion having longitudinal edges, the top edge seal operably connected to a top edge of the side portion proximate a midpoint between the longitudinal edges of the side portion such that a top of the side portion extends out generally transverse from the front and back panel portions at the top edge seal; and at least one re-closeable access means attached to the side portion and adapted to provide selective access to the inner cavity, wherein the re-closeable access means is operably disposed along, and in a substantially transverse relationship to the longitudinal edges of, the side portion.

2. The flexible package of claim 1, wherein the re-closeable access means is a re-closeable zipper means.

3. A flexible package comprising:

a plurality of flexible panel portions forming an inner cavity capable of holding material contents, the plurality of flexible panel portions including:

a front panel portion having a front top edge portion;

a back panel portion having a back top edge portion each of the front and back panels having longitudinal edges, with the back and front top edge portions operably connected together to define a narrow top edge seal;

at least one side panel portion having generally longitudinal edges and a side panel top portion, the top edge seal operably connected to the side panel top portion proximate a midpoint between the generally longitudinal edges of the at least one side panel portion such that the side panel top portion extends out generally transverse from the front and back panel portions at the top edge seal; and at least one access device disposed to the at least one side panel portion to provide access in and out of the inner cavity through the at least one side panel portion, wherein the attachment of the device is substantially transverse to the generally longitudinal edges of the at least one side panel portion.

4. The flexible package of claim 3, wherein the device is a re-closeable zipper device.

5. The flexible package of claim 4, wherein the re-closeable zipper device includes a front flange and a back flange for attachment of the re-closeable zipper device to the flexible package.

6. The flexible package of claim 5, wherein the front flange and the back flange are both attached to an inner surface of the at least one side panel portion.

7. The flexible package of claim 5, wherein inner surfaces of the front flange and the back flange are joined to create a barrier peel seal, and wherein the at least one access panel thither includes a tab proximate the at least one access device such that pulling on the tab will separate the front and back flanges at the peel seal for access to the at least one access device.

8. The flexible package of claim 3, including a main webbing, wherein the main webbing forms at least the front panel portion, the back panel portion, and the at least one side panel portion having the transversely integrated at least one access device.

9. The flexible package of claim 3, wherein each of the plurality of flexible panel portions are formed from distinct webbings.

10. The flexible package of claim 3, further including a handle aperture defined in the flexible package.

11. A flexible package formed by a plurality of flexible panel portions, comprising:

a first panel portion having two generally longitudinal edges and a first panel top edge, wherein the space between the first panel portion edges is a distance A;

a second panel portion substantially parallel to the first panel portion, the second panel portion having two generally longitudinal edges and a second panel top edge, wherein the space between the second panel portion edges is approximately equal to said distance A;

the first and second panel top edges operably connected together to define a narrow top edge seal;

at least one access panel portion having two generally longitudinal edges and an access panel top portion, wherein the space between the edges of the at least one access panel is shorter than said distance A and the access panel edges are operably connected to proximate parallel longitudinal edges of the first and second panel portions, the top edge seal operably connected to the access panel top portion proximate a midpoint between the two generally longitudinal edges of the at least one access panel such that the access panel top portion extends out generally transverse from the first and second panel portions at the top edge seal; and at least one re-closeable device disposed to the at least one access panel portion generally transverse to the longitudinal edges of the at least one access panel, and the first and second panel portions, to provide a re-closeable access opening into an inner cavity of the flexible package.

12. The flexible package of claim 1, wherein the re-closeable device is a re-closeable zipper device.

13. The flexible package of claim 12, wherein the re-closeable zipper device includes a front flange and a back flange for attachment of the re-closeable zipper device to the flexible package.

14. The flexible package of claim 13, wherein inner surfaces of the front flange and the back flange are joined to create a barrier peel seal, and wherein the at least one access panel further includes a tab proximate the at least one access device such that pulling on the tab will separate the front and back flanges at the peel seal for access to the at least one re-closeable device.

15. The flexible package of claim 1, including a main webbing, wherein the main webbing forms at least the first panel portion, the second panel portion, and the at least one access panel portion having the transversely integrated at least one re-closeable device.

16. The flexible package of claim 1, wherein each of the panel portions are formed from distinct webbings.

17. The flexible package of claim 1, further including a handle aperture defined in the flexible package.

* * * * *

UNITED STATES PATENT AND TRADEMARK OFFICE

CERTIFICATE OF CORRECTION

PATENT NO. : 7,040,810 B2
APPLICATION NO. : 10/396295
DATED : May 9, 2006
INVENTOR(S) : Mark Steele It is certified that error appears in the above-identified patent and that said Letters Patent is hereby corrected as shown below:

On cover sheet, under (57) Abstract, Line 8, delete "-" after "access".

On cover sheet, under (76) Inventor, delete inventor's address "21515 Cambria Ave., North, LeSueur, MN (US) 56058" and insert --1007 Lexington Avenue North, New Prague, MN (US) 56071--

Column 11, Line 31, delete "comers" and insert --corners--.

Column 11, Line 35, delete "comers" and insert --corners--.

Column 16, Line 30, delete "thither" and insert --further--.

Insert the following claims after Column 18, Line 14:

--18. The flexible package of claim 13, wherein the front flange and the back flange are both attached to an inner surface of the at least one access panel.

19. The flexible package of claim 13, wherein the front flange is attached to an inner surface of the at least one access panel portion, a first portion of the back flange is connected to the first panel portion and a second portion of the back flange is connect to the second panel portion.

20. The flexible package of claim 19, wherein the at least one access panel portion includes at least one tear notch extending some distance into the at least one access panel portion and proximate the at least one re-closeable access device.

21. The flexible package of claim 19, further including a barrier layer disposed on a surface of at least one of the front and back flanges to prevent bonding of the front and back flanges together during formation of the flexible package.

22. The flexible package of claim 11, wherein at least one of the first panel portion and the second panel portion is gusseted along a longitudinal length of said first or second panel portion proximate the at least one access panel.

23. The flexible package of claim 5, wherein the front flange is attached to an inner surface of the at least one side panel portion, a first portion of the back flange is connected to the front panel portion and a second portion of the back flange is connected to the back panel portion.

UNITED STATES PATENT AND TRADEMARK OFFICE

CERTIFICATE OF CORRECTION

PATENT NO. : 7,040,810 B2
APPLICATION NO. : 10/396295
DATED : May 9, 2006
INVENTOR(S) : Mark Steele It is certified that error appears in the above-identified patent and that said Letters Patent is hereby corrected as shown below:

24. The flexible package of claim 23, wherein at least one side panel portion includes at least one tear notch extending some distance into the at least one side panel portion and proximate the at least one re-closeable device to permit a user to tear away a portion of the at least one side panel portion to expose the at least one re-closeable device.

25. The flexible package of claim 23, further including a barrier layer disposed on a surface of at least one of the front and back flanges to prevent bonding of the front and back flanges together during formation of the flexible package.

26. The flexible package of claim 3, wherein at least one of the front panel portion, the back panel portion, and the at least one side panel portion is gusseted.

27. The flexible package of claim 3, wherein one of the side panel portions not including the at least one access device is gusseted.

28. The flexible package of claim 27, further including a handle aperture extending through the front panel portion, the gusseted side panel portion, and the back panel portion to provide a four layer support structure around said handle aperture.

29. The flexible package of claim 1, wherein at least one of the front and back panel portions is gusseted at a longitudinal gusset line proximate the side portion having the recloseable access means.--

Signed and Sealed this

Third Day of April, 2007

JON W. DUDAS
*Director of the United States Patent and Trademark Office*